US008513901B2

(12) United States Patent
Khayat et al.

(10) Patent No.: US 8,513,901 B2
(45) Date of Patent: Aug. 20, 2013

(54) METHOD AND APPARATUS TO CONTROL LED BRIGHTNESS

(75) Inventors: Joseph Maurice Khayat, Bedford, NH (US); Matthew Murdock, Nashua, NH (US); Robert A. Priegnitz, Algonquin, IL (US)

(73) Assignee: Texas Instruments Incorporated, Dallas, TX (US)

( * ) Notice: Subject to any disclaimer, the term of this patent is extended or adjusted under 35 U.S.C. 154(b) by 445 days.

(21) Appl. No.: 12/965,479

(22) Filed: Dec. 10, 2010

(65) Prior Publication Data

US 2012/0146540 A1 Jun. 14, 2012

(51) Int. Cl.
*H05B 41/36* (2006.01)

(52) U.S. Cl.
USPC ..... 315/302; 315/307; 315/308; 315/291; 315/297

(58) Field of Classification Search
USPC ..... 315/291, 297, 299, 300, 302, 307, 315/308, 311
See application file for complete search history.

(56) References Cited

U.S. PATENT DOCUMENTS 7,855,516 B2 * 12/2010 Tsinker et al. ..... 315/224
2009/0160627 A1 * 6/2009 Godbole ..... 340/310.11

OTHER PUBLICATIONS

"TRIAC analog control circuits for inductive loads" STMicroelectronics, http://www.st.com, Sep. 2008 (16 pages).

* cited by examiner

*Primary Examiner* — Douglas W Owens
*Assistant Examiner* — Jianzi Chen
(74) *Attorney, Agent, or Firm* — William B. Kempler; Wade J. Brady, III; Frederick J. Telecky, Jr.

(57) ABSTRACT

Method and apparatus to control LED brightness are disclosed. An example method includes receiving a dimmer control signal; determining a cutoff point of the dimmer control signal; determining the position of a rising edge signal within the dimmer control signal; determining if the rising edge signal occurred before the cutoff point; and outputting an LED brightness signal indicating full brightness when the rising edge signal occurred before the cutoff point, and indicating a scaled brightness when the rising edge signal did not occur before the cutoff point.

20 Claims, 11 Drawing Sheets

METHOD AND APPARATUS TO CONTROL LED BRIGHTNESS

FIELD OF THE DISCLOSURE

This disclosure relates generally to brightness control, and, more particularly, to a method and apparatus to control light emitting diode (LED) brightness.

BACKGROUND

Light sources are often controlled by light switches containing dimmer circuitry that allows users of the light switch to control the brightness emitted by the light source. The light sources controlled by the light switches are typically incandescent or halogen bulbs, however new light emitting sources have recently been introduced. For example, LED lights are now available as an alternative to incandescent and halogen lighting sources. LED lights are more energy efficient than incandescent or halogen bulbs.

The dimmer circuits used with incandescent and halogen bulbs control the brightness of the light sources by varying the power transmitted to the bulb. Incandescent and halogen bulbs are passive elements and present a resistive load to the dimmer. However, LED lights do not present a resistive load to the dimmer. Consequently, LED lights do not function as expected when dimmed via a conventional dimmer circuit.

DETAILED DESCRIPTION

Light sources such as incandescent and halogen bulbs operate at full brightness when receiving an alternating current (AC) signal. Conventional light dimmers operate by preventing portions of the AC cycle from reaching the light source. This process is known as chopping and operates by beginning transmission of the AC power signal at varying points within the AC cycle to control the AC power received, and thereby brightness produced, by the incandescent bulbs. Chopping the AC power signal can be achieved by circuitry containing a triode for alternating current (TRIAC). A firing angle of the TRIAC can be controlled by modification of a component of the dimmer, such as a resistor. The chopped AC signal provided to the incandescent or halogen bulb is similar to the dimmer control signal 116, shown in FIG. 2. By varying the brightness setting of the dimmer and, by extension, the value of the resistor, a user can modify the firing angle of the TRIAC and therefore move the rising edge of the dimmer control signal 116 to a position earlier or later in the period of the AC source. Controlling the TRIAC firing angle directly controls the amount of power provided to, and thereby the brightness emitted from the light source.

Recently, new lighting technologies such as compact fluorescent (CFL) and Light Emitting Diode (LED) lights have been introduced as a more energy efficient alternative to incandescent or halogen bulbs. LED lights, however, do not function as a resistive load, and therefore do not function properly when receiving the chopped AC signal directly from conventional dimmers. To solve this, an LED driver is used to control the power received by the LED lights. An example LED driver modulates the power signal provided to the LED light to ensure that the LED light operates across all brightness levels in a manner intuitively expected by the user. The LED driver typically receives a control signal to control the power transmitted to the LED light.

Current implementations of LED systems implement techniques that average the chopped AC signal from the dimmer and translate that average into an exponentially scaled control signal input into the LED driver. These implementations typically require complex circuitry and have a slow response time for setting the control signal.

Figure 1:
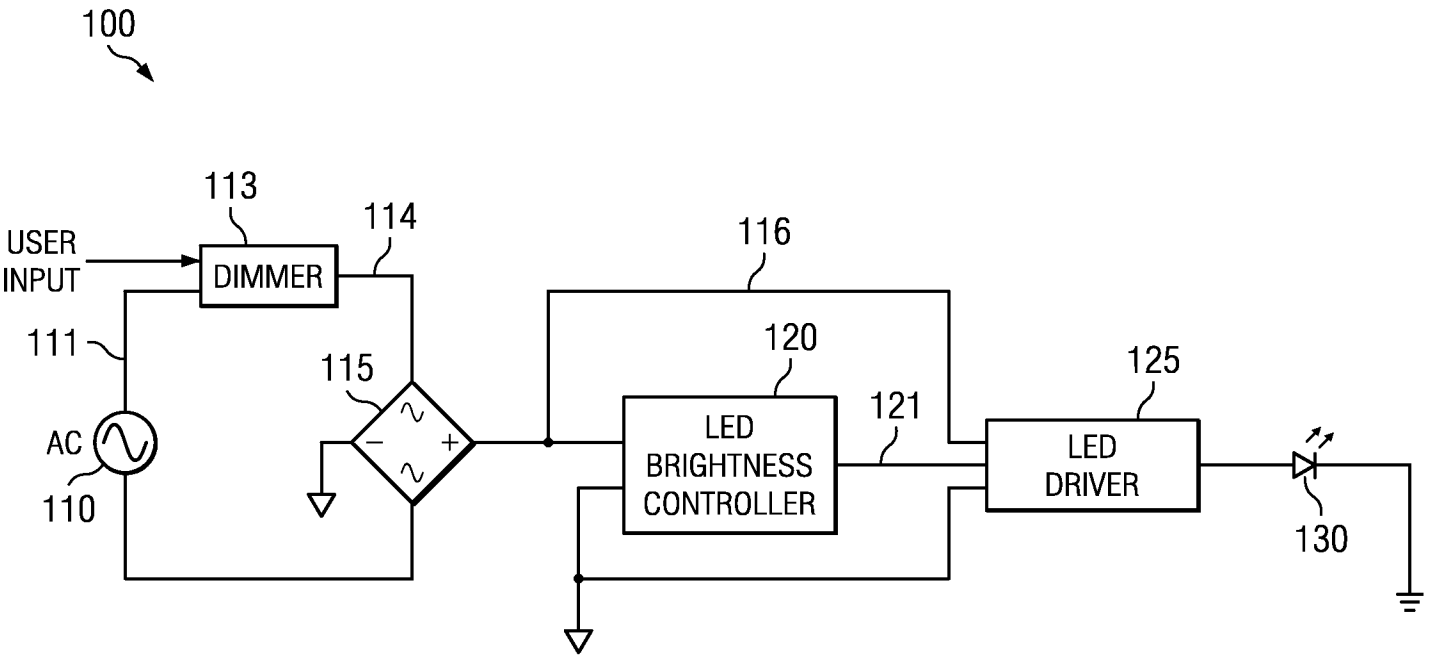
FIG. 1 illustrates an example manner of implementing a system to control LED brightness.

FIG. 1 illustrates an example manner of implementing a system 100 to control LED brightness. The system 100 comprises a dimmer 113, a full bridge rectifier 115, an LED brightness controller 120, an LED driver 125, and an LED 130. Additionally, an AC source 110 provides an AC signal 111 to the dimmer 113 and is coupled the full bridge rectifier 115. The AC source 110 of FIG. 1 represents a voltage source operating at 60 Hz and 120 volts. However, any other frequency and/or voltage may be implemented instead. For example, the AC source 110 may operate at 220 volts and 50 Hz.

The dimmer 113 provides an un-rectified dimmer control signal 114 to the full bridge rectifier 115. The dimmer 113 receives user input via a rheostat such as a knob or a slider to control the un-rectified dimmer control signal 114. While in some examples a rheostat is used, any other circuitry that may enable the dimmer 113 to produce the un-rectified dimmer control signal 114 may additionally or alternatively be used. Further, while in the illustrated example the dimmer 113 is described as including a TRIAC that enables the dimmer 113 to create the un-rectified dimmer control signal 114, any other circuitry may be used to enable creation of the un-rectified dimmer control signal 114. For example, a pair of silicon-controlled rectifiers (SCRs) may be implemented to enable creation of the un-rectified dimmer control signal 114 similar to the example shown in FIG. 2.

The full bridge rectifier 115 of the illustrated example rectifies the un-rectified dimmer control signal 114 to create the dimmer control signal 116. The polarity of the dimmer control signal 116 is positive. However, alternative implementations of the system 100 may not include the full bridge rectifier 115, or the bull bridge rectifier may be integrated into another component. Thus, the full bridge rectifier may be implemented as a component of the dimmer 113 which may generate a rectified dimmer control signal similar to the dimmer control signal 116. Alternatively, the full bridge rectifier may be a component of the LED brightness controller 120 and/or the LED driver 125.

The LED brightness controller 120 provides an LED brightness control signal 121 to the LED driver 125. The LED brightness controller 120 receives the dimmer control signal 116 and is coupled to ground. The LED brightness controller 120 determines the period of the dimmer control signal 116 and the firing angle of the dimmer control signal 116. The LED brightness controller then generates an exponentially scaled LED brightness control signal 121 that is received by the LED driver 125. While in the illustrated example, the LED brightness controller 120 receives power via the dimmer control signal 116, the LED brightness controller may additionally or alternatively receive power via the AC source signal 111.

The LED driver 125 receives the LED brightness control signal 121 and AC power from the full bridge rectifier 115. The LED driver 125 then generates a power signal that is output to the LED 130. In some examples, the power signal represents the AC signal being pulse width modulated at a high frequency based on the LED brightness control signal 121. The power signal is then received by the LED 130 that outputs light at a brightness level representative of the setting indicated by the user on the dimmer 113. While in the illustrated example, the LED driver 125 receives power via the dimmer control signal 116, the LED driver 125 may additionally or alternatively receive power via the AC source signal 111.

While in the example illustrated in FIG. 1 the LED 130 is shown as a single LED, the LED 130 may represent multiple LEDs. For example, a light fixture may comprise two or more LEDs.

Figure 2:
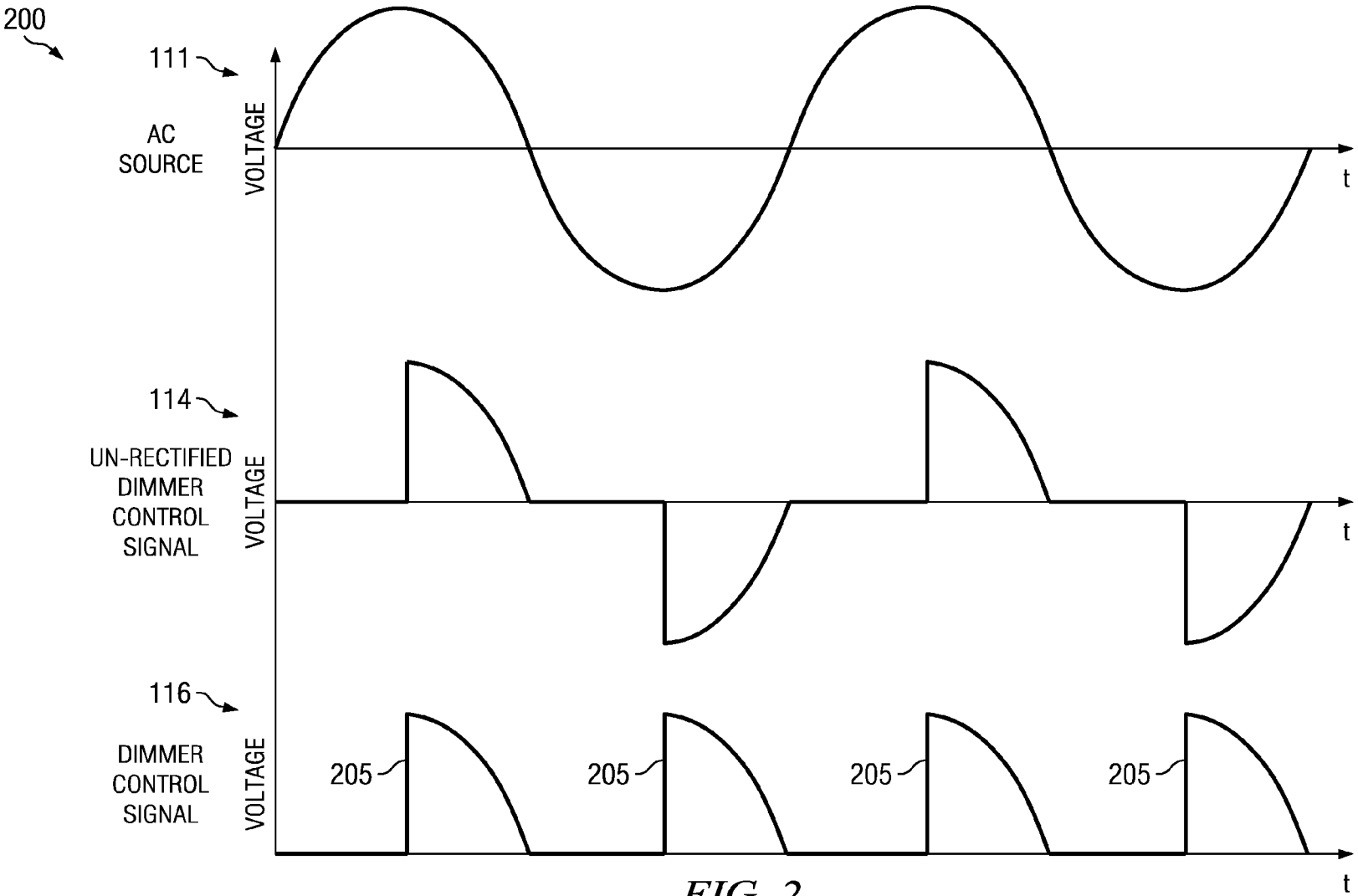
FIG. 2 is a diagram illustrating example signals received by the LED brightness controller of FIG. 1.

FIG. 2 is a diagram illustrating example signals received by the LED brightness controller 120 of FIG. 1. The AC source signal 111, the un-rectified dimmer control signal 114, and the dimmer control signal 116 are illustrated. The un-rectified dimmer control signal 114 is generated by the dimmer 113 based on the AC source signal 111 and the user input received at the dimmer 113. While in the illustrated example, the un-rectified dimmer control signal 114 illustrates the AC source signal 111 being chopped at a 50% firing angle (e.g., only half of each half-cycle of the AC source 111 is output from the dimmer 113), the firing angle may be adjusted based on the input received at the dimmer 113. The dimmer control signal 116 is generated by the full bridge rectifier 115, and represents a rectified version of the un-rectified dimmer control signal 114. The firing angle represents the user input received by the dimmer 113, and is represented by a rising edge 205 within the dimmer control signal 116. For example, if the input to the dimmer 113 indicated that the light should operate at high or full brightness, the firing angle would be much less (e.g., the rising edge 205 of the dimmer control signal 116 would occur at a point earlier in the period of the AC source signal 111). In another example, if the input to the dimmer 113 indicated that the light should operate at low or no brightness, the rising edge 205 would occur at a point later in the period of the AC source signal 111. In a lighting system implementing incandescent or halogen lights, the un-rectified dimmer control signal 114 and/or the dimmer control signal 116 would be supplied directly to the lights, as chopping the AC source signal 111 directly controls the amount of power received and brightness emitted by the lights.

Figure 3:
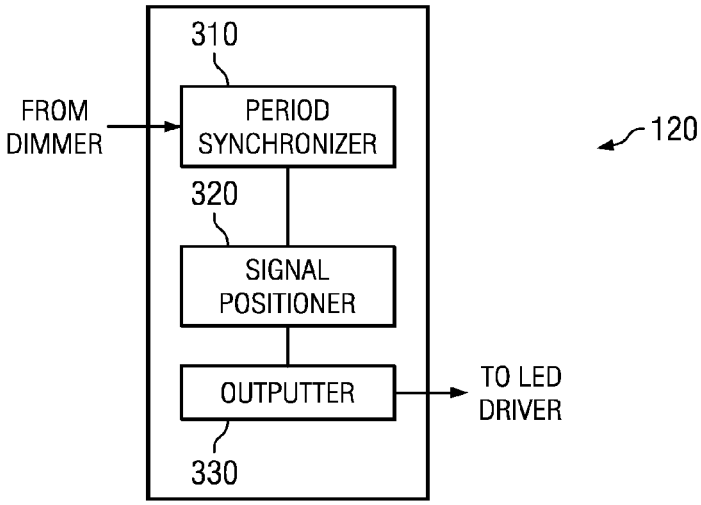
FIG. 3 is a diagram of the example LED brightness controller of the LED brightness control system of FIG. 1.

FIG. 3 is a diagram of the example LED brightness controller 120 of the LED brightness control system 100 of FIG. 1. The LED brightness controller 120 of FIG. 3 comprises a period synchronizer 310, a signal positioner 320, and an outputter 330. The period synchronizer 310 receives the dimmer control signal 116 from the dimmer 113. The outputter 330 outputs the LED brightness control signal 121 to the LED driver 125.

The period synchronizer 310 synchronizes the LED brightness controller 120 to the period of the dimmer control signal and generates timing signals 510 that are transmitted to the signal positioner 320. The timing signals 510 are described in more detail in connection with FIG. 5.

The signal positioner 320 receives the timing signals 510 from the period synchronizer 310 and determines a brightness level that should be sent to the LED 130. The brightness level is output by the outputter 330 and transmitted to the LED driver 125 as the LED brightness control signal 121.

Figure 4:
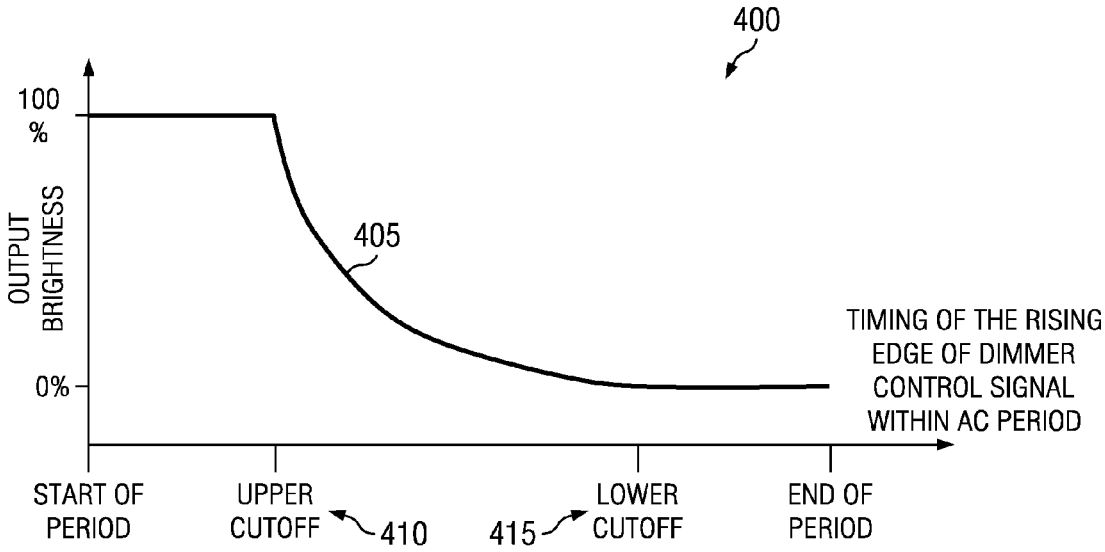
FIG. 4 is a diagram illustrating a brightness curve that may be implemented by the LED brightness controller of the LED brightness control system of FIG. 1.

FIG. 4 is a diagram 400 illustrating a brightness curve 405 that may be implemented by the LED brightness controller 120 of the LED brightness control system 100 of FIG. 1. The horizontal axis shows the time of the rising edge 205 of the dimmer control signal 116, representing the TRIAC firing angle, as received by the LED brightness controller. The vertical axis shows an output brightness given the time of the rising edge 205 of the dimmer control signal 116. Also shown are an upper cutoff 410 and a lower cutoff 415. When the rising edge 205 occurs before the upper cutoff 410, the brightness curve 405 shows that full brightness should be output. When the rising edge 205 occurs after the lower cutoff 415, the brightness curve 405 shows that no brightness should be output.

The cutoffs 410 and 415 are implemented because the accuracy and resolution of the TRIAC firing angle 205 near the extremities of the AC period are very low. For example, when the rising edge 205 is near the beginning or end of the AC period, the integral of the AC waveform does not exhibit much variation as the time within the period is varied. Therefore, the least sensitive region of the dimmer control signal 116 is around the middle of the AC period. When the rising edge 205 of the dimmer control signal 116 occurs after the upper cutoff 410 and before the lower cutoff 415, the brightness curve 405 shows that a scaled brightness should be output. Because the LED 130 exhibits a linear response to stimuli, while the incandescent or halogen lights exhibit a non-linear response to the dimmer, the scaled brightness curve 405 is an exponentially decayed curve that allows the LED 130 to more closely match the dimming characteristics of the incandescent or halogen light that it is replacing.

Figure 5:
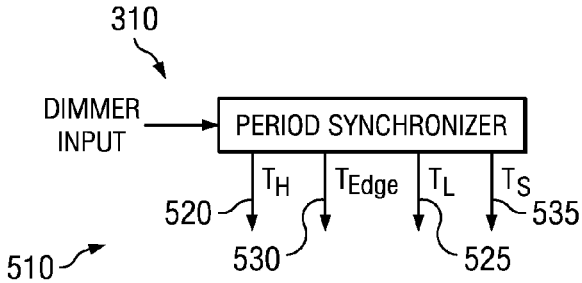
FIG. 5 is a diagram of the example period synchronizer of the LED brightness controller of FIG. 3.

FIG. 5 is a diagram of the example period synchronizer 310 of the LED brightness controller 120 of FIGS. 1 and 3. The example period synchronizer 310 of FIG. 5 receives one input and outputs the timing signals 510. The inputs received are the dimmer control signal 116 and the AC source signal 111. The output timing signals 510 comprise a high cutoff signal ($T_H$) 520, a low cutoff signal ($T_L$) 525, a rising edge signal ($T_{Edge}$) 530, and a sampling signal ($T_S$) 535. The timing signals 510 may be implemented in any fashion. For example, the timing signals 510 may be impulse signals suitable for driving analog circuitry, or the timing signals 510 may be binary signals capable of driving digital circuitry.

The high cutoff signal ($T_H$) 520 represents the upper cutoff 410. While in the examples discussed herein the upper cutoff 410 and the high cutoff signal ($T_H$) 520 are described as being one quarter (e.g., 25%) of the period of the AC source signal 111, any point within the AC period may be used. For example, the rising edge 205 of the dimmer control signal 116 may be determined to be useful as early as the start of the AC period and therefore the upper cutoff 410 and the high cutoff signal 520 may be as early as the start of the AC period. When the rising edge signal ($T_{Edge}$) 530 occurs before the high cutoff signal ($T_H$) 520, the LED is set to output full brightness.

The low cutoff signal ($T_L$) 525 represents the lower cutoff 415. While in the examples discussed herein the lower cutoff 415 and the low cutoff signal ($T_L$) 525 are described as being three quarters (e.g., 75%) of the period of the AC source signal 111, any point within the AC period may be used. For example, the rising edge 205 of the dimmer control signal 116 may be determined to be useful as late as the end of the AC period and therefore the lower cutoff 415 and the low cutoff signal ($T_L$) 525 may be as late as the end of the AC period. When the rising edge signal ($T_{Edge}$) 530 occurs after the low cutoff signal ($T_L$) 525, the LED is set to output minimum brightness.

The rising edge signal ($T_{Edge}$) 530 represents the rising edge 205 of the dimmer control signal 116. In the example shown in FIG. 6, the rising edge signal 205 represents the rising edge 205 that occurs at half of the AC period. However, the rising edge 205, and thereby the rising edge signal 530 may occur at any point within the AC period.

The sampling signal ($T_S$) 535 is generated by the period synchronizer and represents alternating periods of the AC signal. The TRIAC circuitry of the dimmer 113 typically exhibits asymmetry between positive and negative cycles. The TRIAC circuitry of the dimmer 113 is, however, consistent from positive to positive, or negative to negative cycles. Hence within every period the rising edge signal ($T_{Edge}$) 530 is generated, while the sampling signal ($T_S$) 535 may only be generated during alternating periods of the AC cycle. In some implementations, the sampling signal ($T_S$) 535 represents a sampling enable signal (e.g., a binary signal) that may enable circuitry of the LED brightness controller 120 to determine whether or not to utilize the rising edge signal ($T_{Edge}$) 530. In another implementation, the sampling signal ($T_S$) 535 may represent an impulse sampling signal that may instruct circuitry of the LED brightness controller 120 to sample an exponentially decayed waveform.

Figure 6:
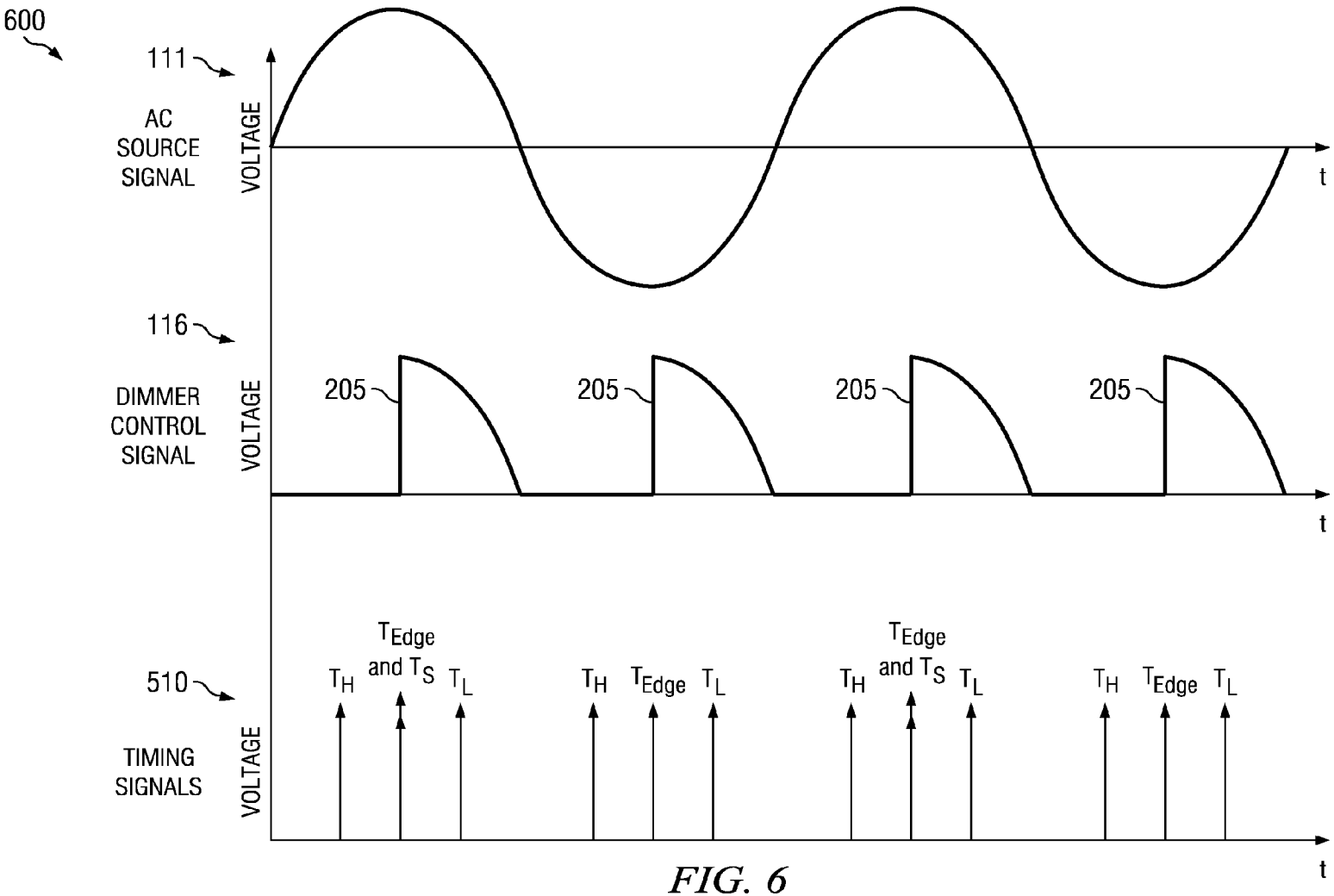
FIG. 6 is a diagram illustrating example signals output by the period synchronizer of FIG. 5.

FIG. 6 is a diagram 600 illustrating example timing signals 510 output by the period synchronizer 310 of FIG. 5. In addition, the diagram 600 illustrates the AC source signal 111 and the dimmer control signal 116. The timing signals 510 shown in FIG. 6 represent four periods of the LED brightness controller 120 where the LED 130 is to be dimmed. In the first period of the AC source signal 111, the high cutoff signal ($T_H$) 520 occurs first, followed by the rising edge signal ($T_{Edge}$) 530 and the sampling signal ($T_S$) 535 at substantially the same time, followed by the low cutoff signal ($T_L$) 525. The second period is substantially the same as the first period, except that the sampling signal ($T_S$) 535 does not occur. The sampling signal ($T_S$) 535 does not occur because the AC source signal is in an alternating period, which, due to asymmetries of the dimmer control signal 116, is ignored. The timing signals 510 of the third and fourth periods are substantially the same as the timing signals of the first and second periods, respectively. While in the illustrated example alternating periods are ignored, in alternative implementations the alternating periods may not be ignored. While in the illustrated example the rising edge signal ($T_{Edge}$) 530 is generated, in alternative implementations the rising edge signal ($T_{Edge}$) 530 may not be generated. In particular, the example signal positioner 320 of FIG. 8 does not require the rising edge signal ($T_{Edge}$) 530 for operation.

Figure 7A:
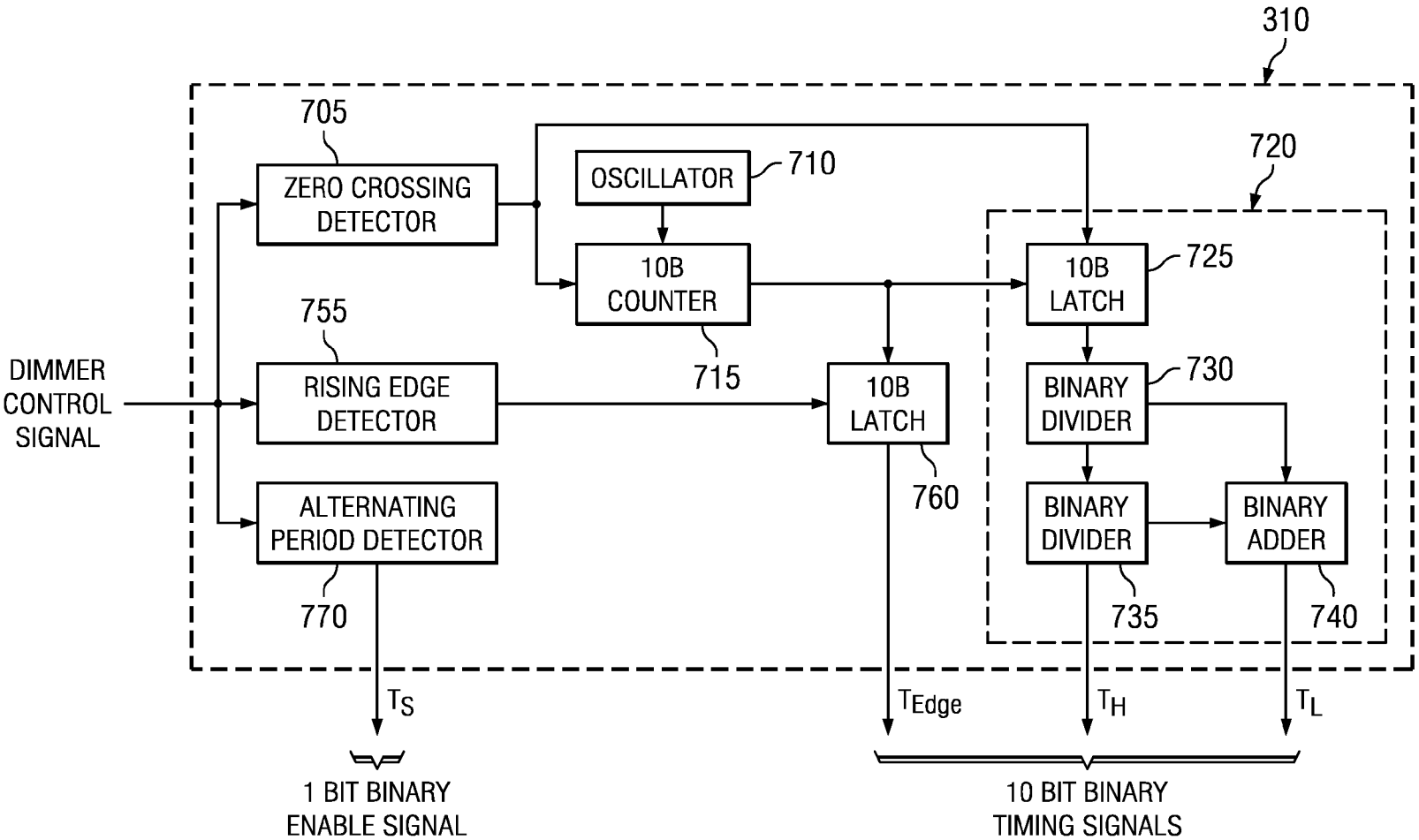
FIGS. 7A and 7B are block diagrams of example implementations of the period synchronizer of FIG. 5.
Figure 7B:
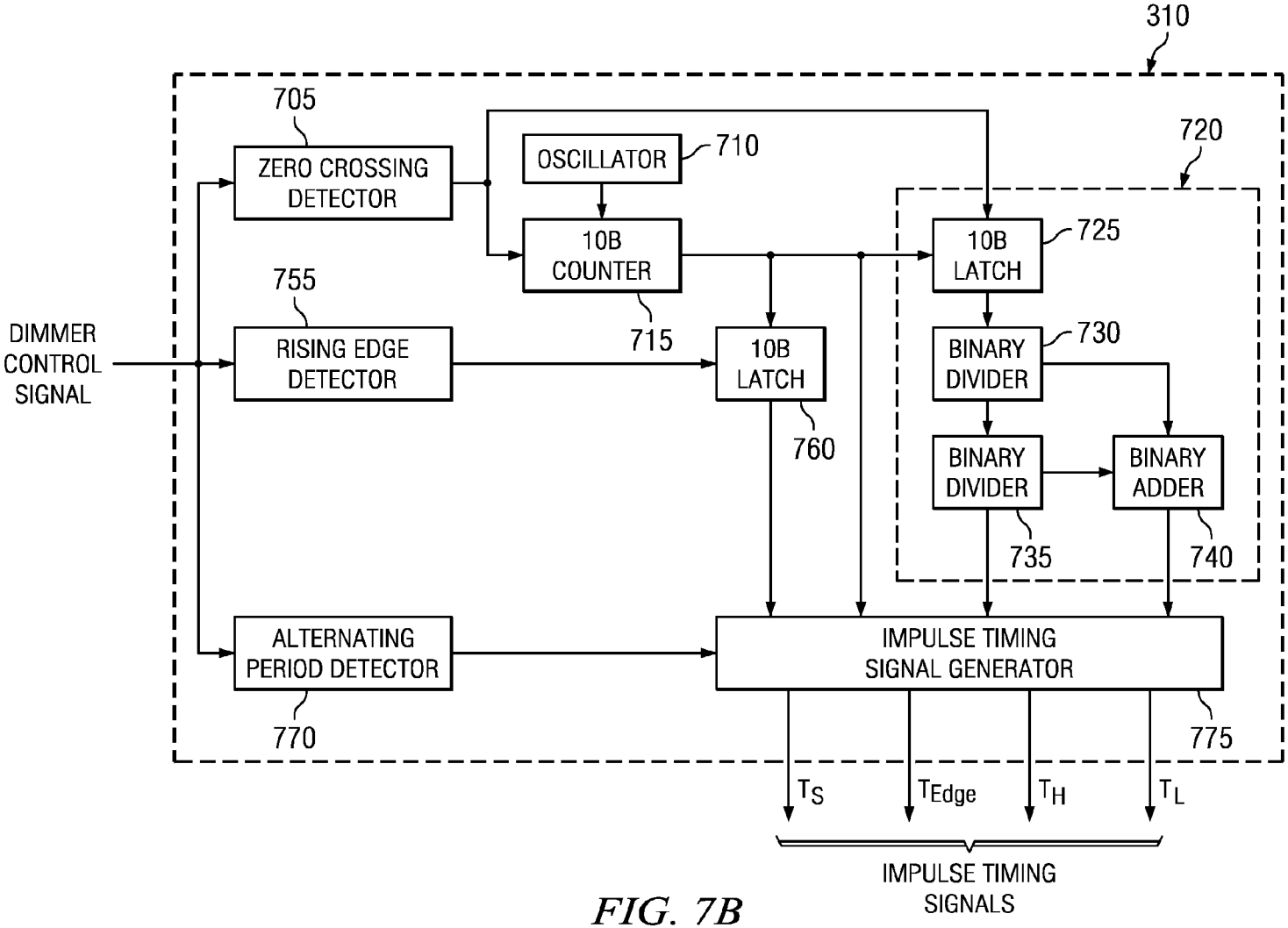

FIGS. 7A and 7B are block diagrams of an example implementation of the period synchronizer 310 of FIGS. 3 and 5. The example period synchronizer 310 receives the dimmer control signal 116, and outputs the timing signals 510.

FIG. 7A is a block diagram illustrating an example implementation of the period synchronizer 310 that outputs the timing signals 510 as three 10-bit binary timing signals and a 1-bit binary enable signal. However, binary timing signals of any length may additionally or alternatively be used. For example, 16-bit binary timing signals may be used. In the illustrated example, the three 10-bit binary timing signals represent the high cutoff signal ($T_H$) 520, the low cutoff signal ($T_L$) 525, and the rising edge signal ($T_{Edge}$) 530. The 1-bit binary enable signal represents the sampling signal ($T_S$) 535 implemented to enable circuitry of the LED brightness controller 120 to determine whether or not to utilize the rising edge signal ($T_{Edge}$) 530.

The example illustrated in FIG. 7A may be implemented when the signal positioner 320 receiving the timing signals 510 is implemented by digital circuitry. The example illustrated in FIG. 7A comprises a zero crossing detector 705, an oscillator 710, a 10-bit binary counter 715, a cutoff generator 720, a rising edge detector 755, a 10-bit binary latch 760 and an alternate period detector 770. The cutoff generator 720 comprises a 10-bit binary latch 725, a first binary divider 730, a second binary divider 735, and a binary adder 740.

The zero crossing detector 705 receives the dimmer control signal 116 and outputs a signal to the 10-bit binary counter 715 and the 10-bit binary latch 725 of the cutoff generator 720. The signal output by the zero crossing detector is a digital signal that represents the zero crossing of the dimmer control signal. The zero crossing occurs at the end of each period of the dimmer control signal 116.

The oscillator 710 is a digital oscillator and provides an oscillating digital signal to the 10-bit binary counter 715. In the illustrated example, the oscillator 710 operates at 80 kHz, however any other frequency may alternatively be used. Of course, using an alternate frequency oscillator 710 may require using additional or alternative counters. The 10-bit binary counter stores a 10-bit binary count and outputs it via a 10-bit binary output. The 10-bit binary counter 715 receives the oscillating digital signal from the oscillator 710 and increments the 10-bit digital count. The 10-bit binary counter 715 also receives the zero crossing detector signal from the zero crossing detector 705 and resets the 10-bit digital count. Therefore, the 10-bit binary signal stored and output by the 10-bit binary counter represents the duration of the rectified AC period. By operating the oscillator 710 at 80 kHz, when the dimmer control signal 116 has a frequency of 120 Hz (twice the frequency of the AC source signal 111 due to the full bridge rectification provided by the dimmer 113), the maximum value of the binary count is approximately 667 and is represented by a 10-bit binary signal. The AC zero crossing to AC zero crossing represents the period of the dimmer control signal 116. Therefore, within one period, 8.33 milliseconds would have passed. The 10-bit digital counter 715 has a total of 1024 counts, and when operated at 80 kHz the maximum amount of time represented by the count is 12.8 milliseconds. Therefore, the 120 Hz dimmer control signal 116 would represent 667 counts, as (8.33 milliseconds/12.8 milliseconds)×1024 counts=667 counts.

The cutoff generator 720 receives the zero crossing detector signal from the zero crossing detector and the count of the 10-bit binary counter 715. The cutoff generator 720 generates the low cutoff signal ($T_L$) 525 and the high cutoff signal ($T_H$) 520. While in the illustrated example, the high cutoff represents one fourth of the maximum value of the binary count, the cutoff generator may generate the high cutoff signal at any point. For example, the high cutoff point may be generated at one third, one fifth, or any other point within the AC period. The high cutoff signal is generated by receiving the 10-bit binary count output by the 10-bit binary counter 715, and storing the count upon receiving the zero crossing detector signal. The stored count thereby represents the maximum value of the binary count. The count stored by the 10-bit binary latch 725 is output first to the first binary divider. In the illustrated example, the first binary divider 730 divides the count by two. The count is divided by two by shifting the received binary count to the right. However, any other method of dividing a count by two may additionally or alternatively be used. The first divided count is output from the first binary divider 730 as an input to the second binary divider 735. The second binary divider 735 also divides the input count by two by shifting the count to the right. Again, any other method may additionally or alternatively be used to divide the count by two. The count output from the second binary divider 735 represents the count stored in the 10-bit binary latch 725 divided by four (e.g., one fourth).

To generate the low cutoff signal ($T_L$) 525, the binary adder 740 adds the first divided count (representing one half of the AC period) from the first binary divider 730 with the second divided count (representing one quarter of the AC period) from the second binary divider 735. The resulting output of the binary adder 740 therefore represents three fourths of the AC period. While in the illustrated example, the low cutoff signal ($T_L$) 525 represents three fourths of the maximum value of the binary count output by the 10-bit binary counter 715, the cutoff generator 720 may generate the low cutoff signal ($T_L$) 525 at any point. For example, the low cutoff signal ($T_L$) 525 may be generated at two thirds, four fifths, or any other point within the AC period. In a further example, the low cutoff signal ($T_L$) 525 may be as late as the end of the AC period. In such an example, the low cutoff signal ($T_L$) 525 may be generated by the zero crossing detector 705 that indicates the start and/or end of an AC period.

The rising edge detector 755 receives the dimmer control signal 116 from the dimmer 113, and detects the rising edge 205. The rising edge detector 775 of the illustrated example is a solid state rising edge detector that outputs an impulse signal when an input signal rises over a set value. The set value may be low in comparison to the rest of the AC period, such that the rising edge detector is most accurate after the high cutoff 410 and before the low cutoff 415. For example, the set value may be a value of the AC period typically occurring prior to the high cutoff signal ($T_H$) 520 or after the low cutoff signal ($T_L$) 525. In the illustrated example, the comparison within the rising edge detector 755 is performed by a comparator, however any other appropriate circuitry may additionally or alternatively be used. The rising edge detector 755 may further comprise a full bridge rectifier so that rising edges 205 occurring in negative AC periods appear as positive rising edges to the comparator.

The rising edge impulse signal generated by the rising edge detector 755 is transmitted to the 10-bit binary latch 760. The 10-bit binary latch 760 receives the current 10-bit binary count from the 10-bit binary counter 715 and the rising edge impulse signal from the rising edge detector 755. The rising edge impulse signal causes the latch 760 to store the count received from the 10-bit binary counter 715. The count stored by the latch 760 therefore represents the point within the AC period at which the rising edge 205 of the dimmer control signal 116 was detected by the rising edge detector 755, representing the firing angle of the TRIAC of the dimmer 113. The count stored by the latch 760 is output as a 10-bit binary timing signal.

The alternate period detector 770 receives the dimmer control signal 116 and outputs a 1-bit binary signal representing alternate periods of the dimmer control signal 116. In the illustrated example, the alternate period detector 770 comprises a comparator that outputs a binary signal representing a positive or negative input. While the example alternate period detector 770 is implemented by a comparator, any other method or circuitry for detecting alternating periods may additionally or alternatively be used.

FIG. 7B is a block diagram illustrating an example implementation of the period synchronizer 310 that outputs the timing signals 510 as impulse timing signals. The example illustrated in FIG. 7B may be implemented when the signal positioner 320 receiving the timing signals 510 is implemented by analog circuitry. In addition to the zero crossing detector 705, the 10-bit binary counter 715, the cutoff generator 720, the rising edge detector 755, the 10-bit binary latch 760, and the alternate period detector 770 illustrated in FIG. 7A, the example illustrated in FIG. 7B additionally includes an impulse timing signal generator 775. The impulse timing signal generator 775 allows the period synchronizer 310 to represent the timing signals 510 as impulse signals. The functionality of the impulse timing signal generator 775 is described in conjunction with FIG. 13.

Similar to the example illustrated in FIG. 7A, the cutoff generator 720 of the example illustrated in FIG. 7B generates a 10-bit binary representation of the upper cutoff point 410 by storing a count representing the AC period, and dividing the count by 4. The 10-bit binary signal representing the upper cutoff point 410 is received by the impulse timing signal generator 775.

The cutoff generator 720 of the example illustrated in FIG. 7B generates a 10-bit binary representation of the lower cutoff point 415 by storing a count representing the AC period, dividing the count by 2 and 4, and adding the two divided counts together. The 10-bit binary signal representing the low cutoff point 415 is received by impulse timing signal generator 775.

Similar to the example illustrated in FIG. 7A, the 10-bit binary latch 760 stores and outputs a 10-bit binary representation of the rising edge signal 205 of the dimmer control signal 116. The 10-bit binary representation of the rising edge signal 205 is received by the impulse timing signal generator 775.

Similar to the example illustrated in FIG. 7A, a sampling enable signal is generated by the example alternate period detector 770. The alternate period detector 770 outputs the sampling enable signal when the dimmer control signal 116 is within an alternate period. In effect, sampling enable signal enables samples to be taken in periods of the like polarities of the AC source signal 111 (e.g., positive or negative periods). The sampling enable signal is output to the impulse timing signal generator 775.

Figure 8:
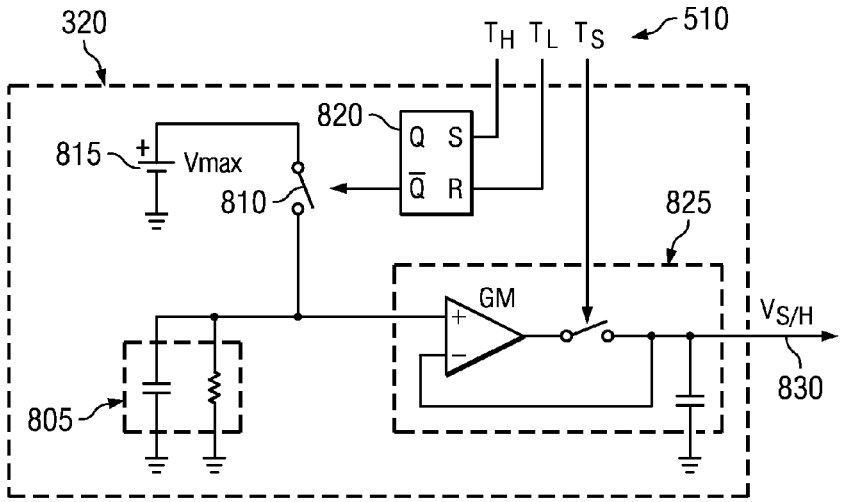
FIG. 8 is a diagram of an example implementation of the example signal positioner of the LED brightness controller of FIG. 3.

The impulse timing signal generator 775 receives the current count of the 10-bit binary counter, the 10-bit binary representation of the upper cutoff point 410, the 10-bit binary representation of the lower cutoff point 415, the 10-bit binary representation of the rising edge signal 205, and the sampling enable signal generated by the example positive period detector 770. The impulse timing signal generator 775 compares the inputs received and generates impulse timing signals capable of driving the signal positioner 320 as shown in FIG. 8.

The output impulse signals of the impulse timing signal generator 775 are generated by comparing the input 10-bit representations to the current count of the 10-bit binary counter 715. When the 10-bit representations or modified versions thereof are equal to the current count of the 10-bit binary counter, the impulse timing signal generator 775 outputs a positive signal (e.g., one output impulse signal per 10-bit representation). While in the illustrated example positive logic is used to generate the output impulse signals, any alternative methods of generating the output impulse signals may be used. For example, negative or inverse logic may be used. In the illustrated example, the output signal remains positive as long as the 10-bit representations are equal to the current count of the 10-bit binary counter. For example, since the minimum amount of time of each increment is 12.5 microseconds, the output impulse signals will last for 12.5 microseconds. However, any duration of impulse signals may alternatively be used. For example, the impulse signals may have a duration of 1 microsecond.

When the impulse timing signal generator 775 is not receiving the sampling enable signal (e.g., when the dimmer control signal 116 is within a negative period), the impulse timing signal generator 775 outputs the high cutoff signal ($T_H$) 520 and the low cutoff signal ($T_L$) 525 as impulse signals representing the 10-bit binary representation of the upper cutoff point and the 10-bit binary representation of the lower cutoff point, respectively. While in the illustrated example, the high cutoff signal ($T_H$) 520 and the low cutoff signal ($T_L$) 525 are output when the impulse timing signal generator 775 is not receiving the sample enable signal, in alternative implementations the signals may not be output.

When the impulse timing signal generator 775 is receiving the sampling enable signal (e.g., when the dimmer control signal 116 is within an alternate period), the impulse timing signal generator 775 outputs the high cutoff signal ($T_H$) 520 representing the 10-bit binary representation of the upper cutoff point, the rising edge signal ($T_{Edge}$) 530 representing the 10-bit binary representation of the rising edge signal 205, the low cutoff signal ($T_L$) 525 representing the 10-bit binary representation of the lower cutoff point 415, and the sampling signal ($T_S$) 535. In general, the sampling signal ($T_S$) 535 is equal to the minimum of either the 10-bit binary representation of the rising edge signal 205 or the 10-bit binary representation of the lower cutoff point 415. While in the illustrated example shown in FIG. 8 the rising edge signal ($T_{Edge}$) 530 is not received by the example signal positioner 320, in alternative implementations the signal positioner 320 may receive the rising edge signal ($T_{Edge}$) 530. In such an implementation, the 10-bit binary representation of the rising edge signal 205 may need to be incremented to facilitate accurate sampling.

Incrementing the 10-bit binary representation of the rising edge signal 205 by 1 delays the rising edge signal ($T_{Edge}$) 530 by 12.5 microseconds. Because the sampling signal is controlling sample and hold circuitry as shown in FIG. 8, if the sample were taken at the same time as the rising edge signal ($T_{Edge}$) 530 it is likely that the LED 130 would output a brightness level greater than intended, as the sampled circuitry in FIG. 8 may have deviated from the intended sampling value. This is particularly true when the 10-bit binary representation of the rising edge signal 205 is greater than the 10-bit binary representation of the upper cutoff point 410. In the illustrated example, the sample and hold circuitry acquires an accurate sample in less than 12.5 microseconds and therefore a minimum level of increment is needed (e.g., an increment of 1, corresponding to 12.5 microseconds). However, in alternative implementations, accurate sampling may not occur in less than 12.5 microseconds, and therefore a larger increment may be necessary. Additionally or alternatively, the 10-bit binary representation of the rising edge signal 205 may not need to be incremented. For example, switching circuitry (e.g., relays, transistors, latches, etc. . . . ) of the example signal positioner 320 may cause additional delays which may negate the need for incrementing the 10-bit binary representation of the rising edge signal 205.

When the 10-bit representation of the rising edge signal 205 is less than the 10-bit binary representation of the upper cutoff point 410, a 10-bit binary representation of the sampling signal is set to the same value as the 10-bit binary representation of the rising edge signal 205. The 10-bit binary representation of the sampling signal is thereby output as the sampling signal ($T_S$) 535 and indicates that maximum brightness should be output by the LED 130. Further, the 10-bit binary representation of the rising edge signal 205 may be incremented by one count (e.g., the sampling signal ($T_S$) 535 is delayed by 12.5 microseconds) to ensure that a correct sample is taken. While in the illustrated example, the high cutoff signal ($T_H$) 520 and the low cutoff signal ($T_L$) 525 are output when the 10-bit representation of the rising edge signal 205 is less than the 10-bit binary representation of the upper cutoff point 410, in alternative implementations the signals may not be output.

When the 10-bit representation of the rising edge signal 205 is greater than or equal to the 10-bit binary representation of the upper cutoff point 410 and less than the 10-bit binary representation of the lower cutoff point 415, the 10-bit binary representation of the sampling signal is set to the same value as the 10-bit binary representation of the rising edge signal 205. The 10-bit binary representation of the sampling signal is thereby output as the sampling signal ($T_S$) 535 and indicates that a scaled brightness should be output by the LED 130. Further, the 10-bit binary representation of the rising edge signal 205 may be incremented by one count to ensure that a correct sample is taken.

When the 10-bit representation of the rising edge signal 205 is greater than or equal to the 10-bit binary representation of the lower cutoff point 415, the 10-bit binary representation of the sampling signal is set to the same value as the 10-bit binary representation of the lower cutoff point 415. The 10-bit binary representation of the sampling signal is thereby output as the sampling signal ($T_S$) and indicates that no brightness should be output by the LED 130. In the illustrated example, the 10-bit binary representation of the lower cutoff point 415 is incremented (e.g., the low cutoff signal ($T_L$) 525 is delayed) to allow for proper sampling. While in the illustrated example, the 10-bit binary representation of the lower cutoff point 415 is incremented by 1, the 10-bit binary representation of the lower cutoff point 415 is incremented by any other value up to and including a value that would increment the 10-bit binary representation to the end of the AC period. In a further implementation, the 10-bit binary representation of the lower cutoff point 415 may represent the rising edge signal ($T_{Edge}$) 530. In such a scenario, the rising edge signal ($T_{Edge}$) 530 occurs after the lower cutoff point 415 and before the end of the AC period. Thus, instead of incrementing the 10-bit binary representation of the lower cutoff point 415, the 10-bit binary representation of the lower cutoff point 415 may be set to a value known to be within an acceptable range (e.g., after the lower cutoff point 415 but before the end of the AC period.)

FIG. 8 is a diagram of an example implementation of the example signal positioner 320 of the LED brightness controller 120 of FIGS. 1 and 5. The example signal positioner 320 of FIG. 8 comprises a circuit 805, a switch 810, a voltage source 815, a set-reset latch 820, and sample and hold circuitry 825. The example signal positioner 320 receives the timing signals 510, and outputs a sample and hold voltage 830.

The example circuit 805 comprises a resistor and a capacitor. While in the illustrated example, only a resistor and a capacitor are shown, any other circuitry may additionally or alternatively be used. For example, multiple capacitors and/or resistors may be used to achieve a particular response. The example circuit is switched between charging and decaying by the switch 810. In the illustrated example, the switch is implemented by a relay driven by the signal received from the set-reset latch 820, however any other method of electronically controlling a switch may additionally or alternatively be used. For example, solid-state switches such as transistors may be implemented to controllably enable and/or disable the circuit 805. When the switch 810 is closed, current flows from the voltage source 815 and charges the circuit 805. When the switch 810 is open, the voltage stored in the circuit 805 decays. The circuit 805 exhibits an exponentially decayed response matching the exponential response of the brightness curve 405 illustrated in FIG. 4. While in the illustrated example an exponential response is described, the circuit 805 may have any response. For example, the circuit 805 may have a linear response.

The voltage source 815 provides a charging voltage ($V_{MAX}$) to the circuit 805 when the switch is closed. The voltage represents the maximum value that the circuit 805 will charge to when the switch 810 is closed. In the illustrated example, the voltage source 815 is supplied by the reference voltages generated in the LED brightness controller 320. However, any other apparatus for generating a voltage may additionally or alternatively be used.

The set-reset latch 820 provides a control signal to the switch 810. The set-reset latch 820 receives the high cutoff signal ($T_H$) 520 as a set signal, and receives the low cutoff signal ($T_L$) 525 as a reset signal. Although the illustrated example of FIG. 8 shows the low cutoff signal ($T_L$) 525 as the reset signal to the set-reset latch 820, the rising edge signal ($T_{Edge}$) 530 may additionally serve as the reset signal via digital logic such as an OR gate. Additionally or alternatively, other signals may be implemented as the low cutoff signal such as, for example, a zero crossing signal generated by the zero crossing detector 705 of FIGS. 7A and 7B. Assuming that the initial state of the switch is closed (e.g., the set-reset latch is reset), the circuit 805 charges. When the high cutoff signal ($T_H$) 520 is received, the set-reset latch 820 becomes set, and the state of the switch 810 becomes open. Once the switch 810 becomes open, the voltage across the circuit 805 begins to decay. Once the reset signal (either the low cutoff signal ($T_L$) 525 or the rising edge signal ($T_{Edge}$) 530) is received, the set-reset latch 820 becomes reset, and the switch 810 is closed. Once the switch 810 is closed, the circuit 805 charges to the charging voltage provided by the voltage source 815.

The sample and hold circuit 825 receives the voltage from the circuit 805, and stores that voltage in response to receiving the sampling signal ($T_S$) 535. In the illustrated example the sample and hold circuit 825 is comprised of an op amp having the positive input connected to the circuit 805, and having the negative input coupled to the output via a sampling switch. Further, a capacitor couples the output of the op amp to ground via the sampling switch. When the sampling switch is closed, the voltage across the circuit 805 is sampled and held. The sampled and held voltage is output as the sample and hold voltage 830.

Figure 9:
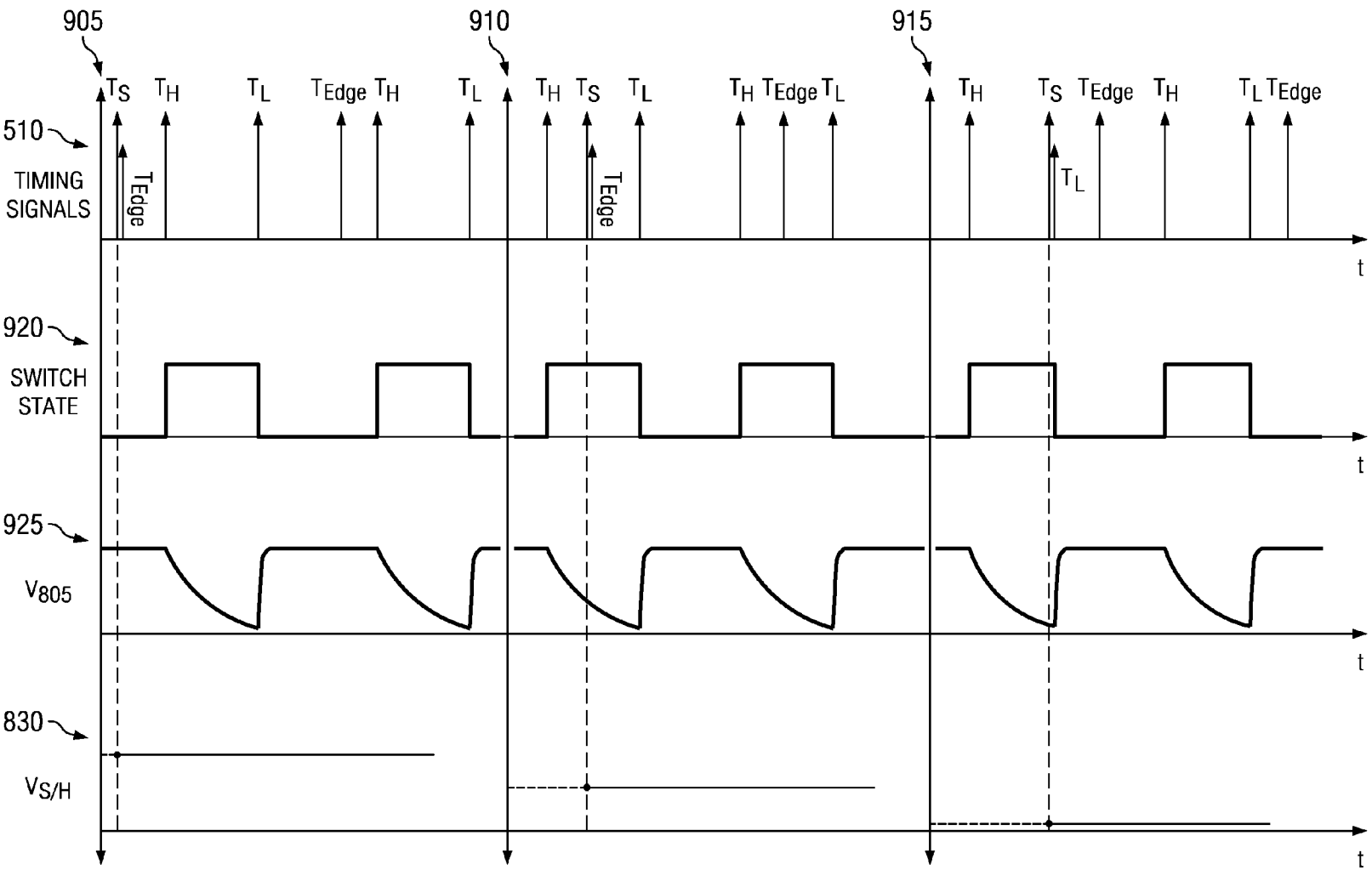
FIG. 9 is a timing diagram illustrating the example inputs and outputs of the example signal positioner of FIG. 8.

FIG. 9 is a timing diagram illustrating the example timing signals 510 and output sampled and held voltage 830 of the example signal positioner 320 of FIG. 8. In the example illustrated in FIG. 9, the example timing signals 510 includes the rising edge signal ($T_{Edge}$) 530, however alternative implementations may not include this signal as discussed below. The timing diagram illustrates a first case 905 when the sampling signal ($T_S$) 535 occurs before the high cutoff signal ($T_H$) 520 (e.g., full brightness), a second case 910 when the sampling signal ($T_S$) 535 occurs after the high cutoff signal ($T_H$) 520 and before the low cutoff signal ($T_L$) 525 (e.g., scaled brightness), and a third case 915 when sampling signal ($T_S$) 535 occurs immediately before the low cutoff signal ($T_L$) 525 (e.g., no brightness). The horizontal axis of the timing diagram of FIG. 9 represents time. The vertical axis of the timing diagram of FIG. 9 represents four signals: the timing signals 510, a switch state signal 920, a voltage signal 925, and the sampled and held voltage 830. The switch state signal 920 represents the state of the switch 810. When the switch state signal 920 is high, the switch 810 is open, and when the switch state signal 920 is low, the switch 810 is closed. The voltage signal 925 represents the voltage across the circuit 805. The maximum voltage of the illustrated voltage signal 925 is therefore $V_{MAX}$, the voltage supplied by the voltage source 815. In describing the three cases presented in the illustrated example, it is assumed that similar periods have occurred prior to each of the cases. However, this need not be the case, as a user could vary the input to the dimmer and cause the desired brightness level of the LED 130 to change.

The first case 905 illustrates the case where sampling signal ($T_S$) 535 occurs before the high cutoff signal ($T_H$) 520. First, the sampling signal ($T_S$) 535 is received and causes the voltage signal 925 to be sampled as the sample and hold voltage 830. In the illustrated example, the set-reset latch 820 was previously reset (e.g., the voltage signal 925 was at its highest level), as the low cutoff signal ($T_L$) 525 in a hypothetical previous AC cycle would have caused the set-reset latch 820 to become reset. Because the previous state of the sample and hold voltage 830 is not known, the sample and hold voltage 830 prior to the sampling signal ($T_S$) 535 is represented as a dotted line. Once the voltage across the circuit 805 is sampled, the sample and hold voltage 830 is known, and is represented by a solid line. Next, the rising edge signal ($T_{Edge}$) 530 is received, however the signal is ignored by the signal positioner 320. In alternative implementations, the rising edge signal ($T_{Edge}$) 530 may not be ignored and may be implemented as an input to the reset terminal of the set-reset latch 820 via an OR gate coupled to the low cutoff signal ($T_L$) 525. In such an implementation, the rising edge signal ($T_{Edge}$) 530 would cause the set-reset latch 820 to remain reset.

Upon receiving the high cutoff signal ($T_H$) 520 the set-reset latch 820 becomes set, and the state of the switch 810 changes from closed to open. The change in the state of the switch 810 causes the voltage signal 925 to decay. Next, the low cutoff signal ($T_L$) 525 causes the set-reset latch 820 to become reset, and the switch 810 changes from open to closed. The change in the state of the switch 810 causes the voltage signal 925 to quickly return to $V_{MAX}$, as supplied by the voltage source 815. Since the dimmer control signal 116 is periodic, the next period is an alternating period, and the sampling signal ($T_S$) 535 does not occur. Since the voltage across the circuit is not re-sampled, the sample and hold voltage 830 remains constant. The output sample and hold voltage 830 is therefore equal to $V_{MAX}$.

In alternative implementations, the high cutoff signal ($T_H$) 520 and the low cutoff signal ($T_L$) 525 may not be present in the first period of the first case 905. For example, the impulse timing signal generator 775 might not output the high cutoff signal ($T_H$) 520 and the low cutoff signal ($T_L$) 525 when the 10-bit binary representation of the rising edge signal 205 is less than the 10-bit binary representation of the upper cutoff point 410. In a further alternative implementation, the high cutoff signal ($T_H$) 520 and the low cutoff signal ($T_L$) 525 may not be present in the second period of the first case 905. For example, the impulse timing signal generator 775 might not output the high cutoff signal ($T_H$) 520 and the low cutoff signal ($T_L$) 525 when the sampling enable signal is not received. In such implementations, the voltage signal 925 would not decay, rather it would stay equal to $V_{MAX}$ as supplied by the voltage source 815.

The second case 910 illustrates the case where the sampling signal ($T_S$) 535 occurs after the high cutoff signal ($T_H$) 520 and before the low cutoff signal ($T_L$) 525. First, the high cutoff signal ($T_H$) 520 is received and the set-reset latch 820 becomes set, causing the switch 810 to become open and the voltage across the circuit 805 to decay. Next, the sampling signal ($T_S$) 535 is received. The sampling signal ($T_S$) 535 causes the sample and hold circuitry 825 to sample the decayed voltage across the circuit 805. Because the voltage across the circuit 805 decays at an exponential rate, the time at which the sampling signal ($T_S$) 535 occurs causes an exponentially scaled voltage to be sampled after the high cutoff signal ($T_H$) 520. Next, the rising edge signal ($T_{Edge}$) 530 is received, however the signal is again ignored by the signal positioner 320. In alternative implementations, the rising edge signal ($T_{Edge}$) 530 may not be ignored and may be implemented as an input to the reset terminal of the set-reset latch 820 via an OR gate coupled to the low cutoff signal ($T_L$) 525. In such an implementation, the rising edge signal ($T_{Edge}$) 530 would cause the set-reset latch 820 to become reset, and the voltage across the circuit 805 to return to $V_{MAX}$. When the low cutoff signal ($T_L$) 525 is received, the set-reset latch 820 becomes reset, and therefore the voltage across the circuit 805 returns to $V_{MAX}$.

Because the previous state of the sample and hold voltage 830 is not known, the sample and hold voltage 830 prior to the sampling signal ($T_S$) 535 is represented as a dotted line. Once the voltage signal 925 is sampled, the sample and hold voltage 830 is known, and is represented by a solid line. Similar to the first case, the sampling signal is not received during the second AC period, and therefore the sample and hold voltage 830 remains constant throughout the second AC period. While in the illustrated example the high cutoff signal ($T_H$) 520 and low cutoff signal ($T_L$) 525 are received during the second period of the second case 910, alternative implementations may not receive the high cutoff signal ($T_H$) 520 and low cutoff signal ($T_L$) 525 are during the second period. For example, the impulse timing signal generator 775 might not output the high cutoff signal ($T_H$) 520 and the low cutoff signal ($T_L$) 525 when the sampling enable signal is not received.

The third case 915 illustrates the case where the sampling signal ($T_S$) 535 is received immediately before the low cutoff signal ($T_L$) 525. First, the high cutoff signal ($T_H$) 520 is received and causes the set-reset latch 820 to become set, thereby causing the switch 810 to become open and the voltage signal 925 to decay. The voltage signal 925 decays until it reaches a level representing no brightness. The sampling signal ($T_S$) 535 is then received, followed by the low cutoff signal ($T_L$) 525. The delay of the low cutoff signal ($T_L$) 525 provides sufficient time for the sample and hold circuitry 825 to sample the voltage signal 925 in response to the sampling signal ($T_S$) 535. Additionally or alternatively, the low cutoff signal ($T_L$) 525 may be delayed to as late as the end of the AC period, thus causing the circuit 805 to recharge at a zero crossing of the AC source. The sampled voltage is then output as the sample and hold voltage 830 which indicates no brightness should be output by the LED 130. Because the previous state of the sample and hold voltage 830 is not known, the sample and hold voltage 830 prior to the sampling signal ($T_S$) 535 is represented as a dotted line. Once the voltage signal 925 is sampled, the sample and hold voltage 830 is known, and is represented by a solid line.

Next, the rising edge signal ($T_{Edge}$) 530 is received, however the signal is again ignored by the signal positioner 320. In alternative implementations, the rising edge signal ($T_{Edge}$) 530 may not be ignored and may be implemented as an input to the reset terminal of the set-reset latch 820 via an OR gate coupled to the low cutoff signal ($T_L$) 525. In such an implementation, the rising edge signal ($T_{Edge}$) 530 would cause the set-reset latch 820 to remain reset, thereby resulting in no state change. Again, since the dimmer control signal 116 is periodic, the next period is negative, and the sampling signal ($T_S$) 535 does not occur. Since the voltage across the circuit 805 is not re-sampled, the sample and hold voltage 830 remains constant. While in the illustrated example the high cutoff signal ($T_H$) 520 and low cutoff signal ($T_L$) 525 are received during the second period of the third case 915, alternative implementations may not receive the high cutoff signal ($T_H$) 520 and low cutoff signal ($T_L$) 525 are during the second period. For example, the impulse timing signal generator 775 might not output the high cutoff signal ($T_H$) 520 and the low cutoff signal ($T_L$) 525 when the sampling enable signal is not received.

Figure 10:
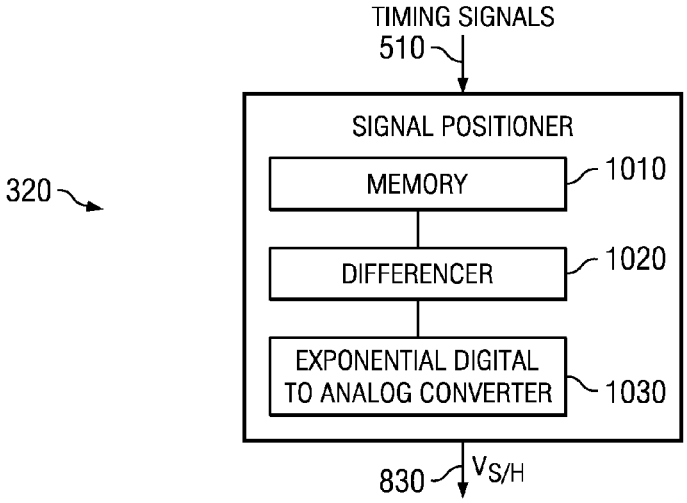
FIG. 10 is an example implementation of the example signal positioner of the LED brightness controller of FIG. 5.

FIG. 10 is an example implementation of the example signal positioner 320 of the LED brightness controller 120 of FIG. 5. The example signal positioner 320 of FIG. 10 includes a memory 1010, a differencer 1020, and an exponential digital to analog converter 1030. Similar to the example signal positioner shown in FIG. 8, the example signal positioner 320 shown in FIG. 10 receives the timing signals 510 and outputs the sample and hold voltage 830.

In the illustrated example, the memory 1010 is a non-volatile memory. However, the memory 1010 may additionally or alternatively be implemented by any other type of memory such as, for example, a volatile memory. In the illustrated example, the timing signals 510 are received as binary timing signals similar to the binary timing signals generated by the period synchronizer 310 of FIG. 7A. The memory 1010 stores the received timing signals 510, including the sampling signal ($T_S$) 535 that indicates when the AC source signal 111 is within a positive period. Additionally, the memory 1010 may store timing signals from previous periods to allow for sampling signals to be averaged over time. Averaging the sampling signals over time allows the LED brightness controller 120 to provide gradually scaled brightness that may be more appealing to users than sharply scaled brightness. Beyond simple averaging, more complex schemes may be achieved for filtering out asymmetry present in the TRIAC circuitry of the dimmer 113. For example, instead of skipping the negative AC periods, the signal positioner may additionally or alternatively skip positive periods that have deviated more than a certain amount to prevent the LED 130 from flickering or providing an unsteady brightness.

First, the differencer 1020 determines whether the count representing the rising edge signal ($T_{Edge}$) 530 is lower than the count representing the high cutoff point ($T_H$) 520. If the rising edge signal ($T_{Edge}$) 530 is lower than the high cutoff point ($T_H$) 520, the differencer 1020 outputs a value representing full brightness to the exponential digital to analog converter 1030. Next, the differencer 1020 determines whether the rising edge signal ($T_{Edge}$) 530 is greater than the low cutoff point ($T_L$) 525. If the rising edge signal ($T_{Edge}$) 530 is greater than the low cutoff point ($T_L$) 525 the differencer 1020 outputs a value representing no brightness to the exponential digital to analog converter 1030.

If the differencer 1020 determines that the rising edge signal ($T_{Edge}$) 530 is neither lower than the high cutoff point ($T_H$) 520 nor greater than the low cutoff point ($T_L$) 525, then the rising edge signal ($T_{Edge}$) 530 is between the lower and higher cutoff points 520, 525. The differencer 1020 then subtracts the count representing the high cutoff point ($T_H$) 520 from the count representing the rising edge signal ($T_{Edge}$) 530 as a difference value. The subtracted difference value represents a linear amount of time that has passed between the high cutoff point ($T_H$) 520 and the rising edge signal ($T_{Edge}$) 530. While in the illustrated example, the value represents the difference between the rising edge signal ($T_{Edge}$) 530 and the high cutoff point ($T_H$) 520, the value may additionally or alternatively represent the difference between the rising edge signal ($T_{Edge}$) 530 and the low cutoff point ($T_L$) 525. Further, while in the illustrated example, the difference value is the only signal transmitted to the exponential digital to analog converter, additional or alternative difference values may be transmitted such as, for example, the difference between the low and high cutoff points 525, 520.

The exponential digital to analog converter 1030 converts the linear difference value into an exponential brightness curve similar to the brightness curve 405 shown in FIG. 2. The exponential digital to analog converter 1030 outputs the sample and hold voltage 830 as an analog value. While in the illustrated example, a converter is used to convert the calculated differences between the timing signals into an analog voltage, any other circuitry may additionally or alternatively be used such as, for example, a look up table stored in the memory 1010 may be used.

Figure 11:
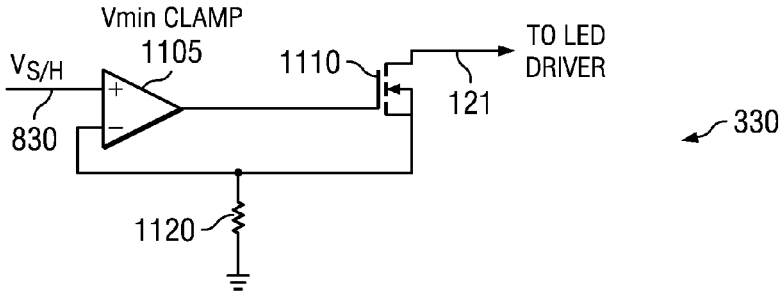
FIG. 11 is an example implementation of the example outputter of the LED brightness controller of FIG. 5.

FIG. 11 is an example implementation of the example outputter 330 of the LED brightness controller 120 of FIG. 5. The outputter 330 receives the sample and hold voltage 830 from the example signal positioner 320, and outputs the brightness control signal 121 to the LED driver 125. The outputter 330 comprises an op-amp 1105, a transistor 1110, and a resistor 1120. The brightness control signal 121 can thereby be scaled to a range acceptable for use with the LED driver 125 by varying the resistance of the resistor 1120.

While an example manner of implementing the LED brightness controller 120 of FIGS. 1 and 3 has been illustrated in FIGS. 4 through 11, one or more of the elements, processes and/or devices illustrated in FIGS. 4 through 11 may be combined, divided, re-arranged, omitted, eliminated and/or implemented in any other way. Further, the example period synchronizer 310, the example signal positioner 320, the example outputter 330 and/or, more generally, the example LED brightness controller 120 of FIGS. 1 and 3 may be implemented by hardware, software, firmware and/or any combination of hardware, software and/or firmware. Thus, for example, any of the example period synchronizer 310, the example signal positioner 320, the example outputter 330 and/or, more generally, the example LED brightness controller 120 of FIGS. 1 and 3 could be implemented by one or more circuit(s), programmable processor(s), application specific integrated circuit(s) (ASIC(s)), programmable logic device (s) (PLD(s)) and/or field programmable logic device(s) (FPLD(s)), etc. When any of the appended apparatus claims are read to cover a purely software and/or firmware implementation, at least one of the example period synchronizer 310, the example signal positioner 320, and/or the example outputter 330 are hereby expressly defined to include a computer readable medium such as a memory, DVD, CD, etc. storing the software and/or firmware. Further still, the example LED brightness controller 120 of FIGS. 1 and 3 may include one or more elements, processes and/or devices in addition to, or instead of, those illustrated in FIGS. 4 through 11, and/or may include more than one of any or all of the illustrated elements, processes and devices.

Figure 12:
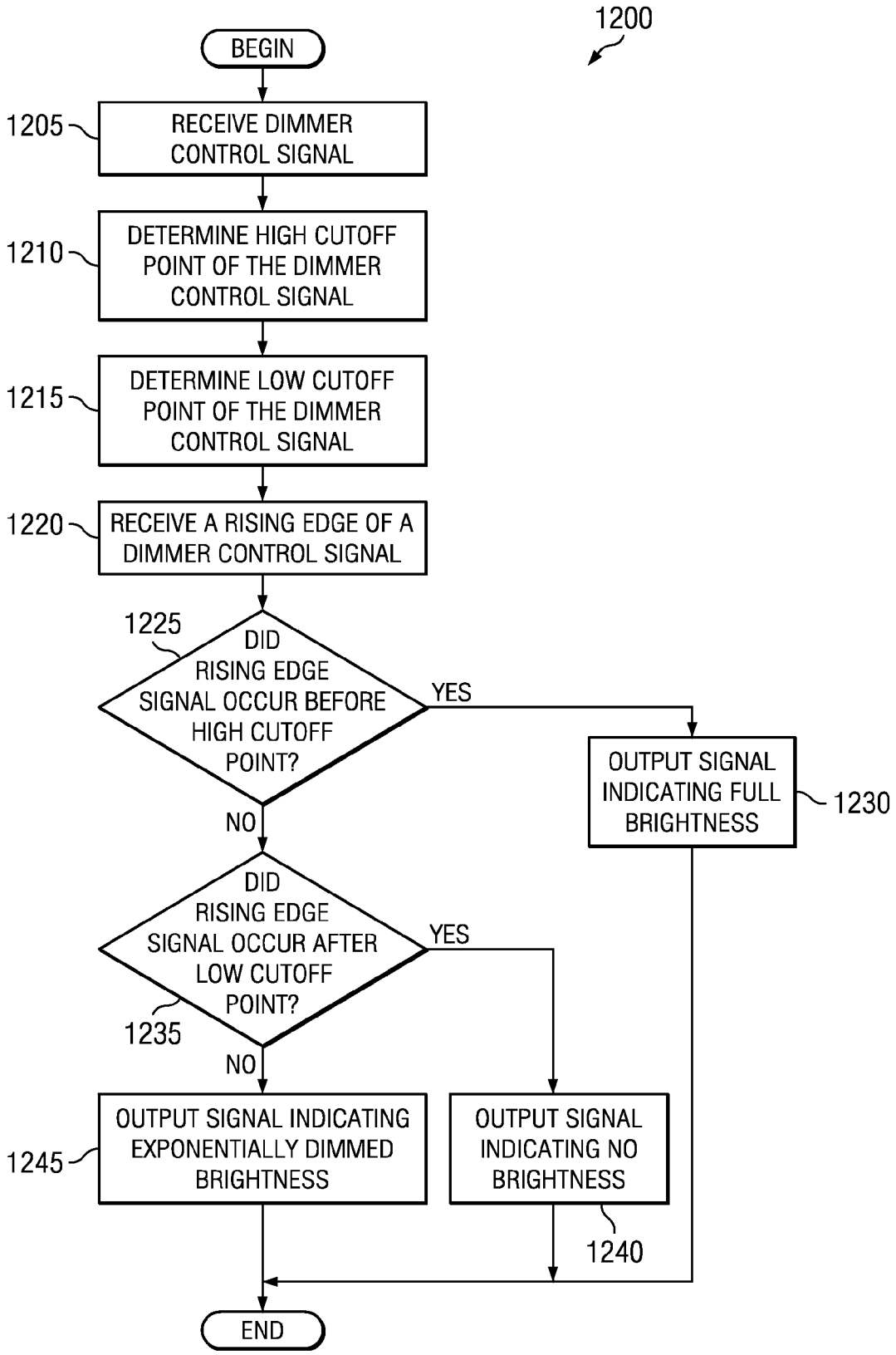
FIG. 12 is a flowchart representative of a process that may be implemented using example machine-readable instructions that may be executed to implement the example LED brightness controller of FIG. 5.
Figure 13:
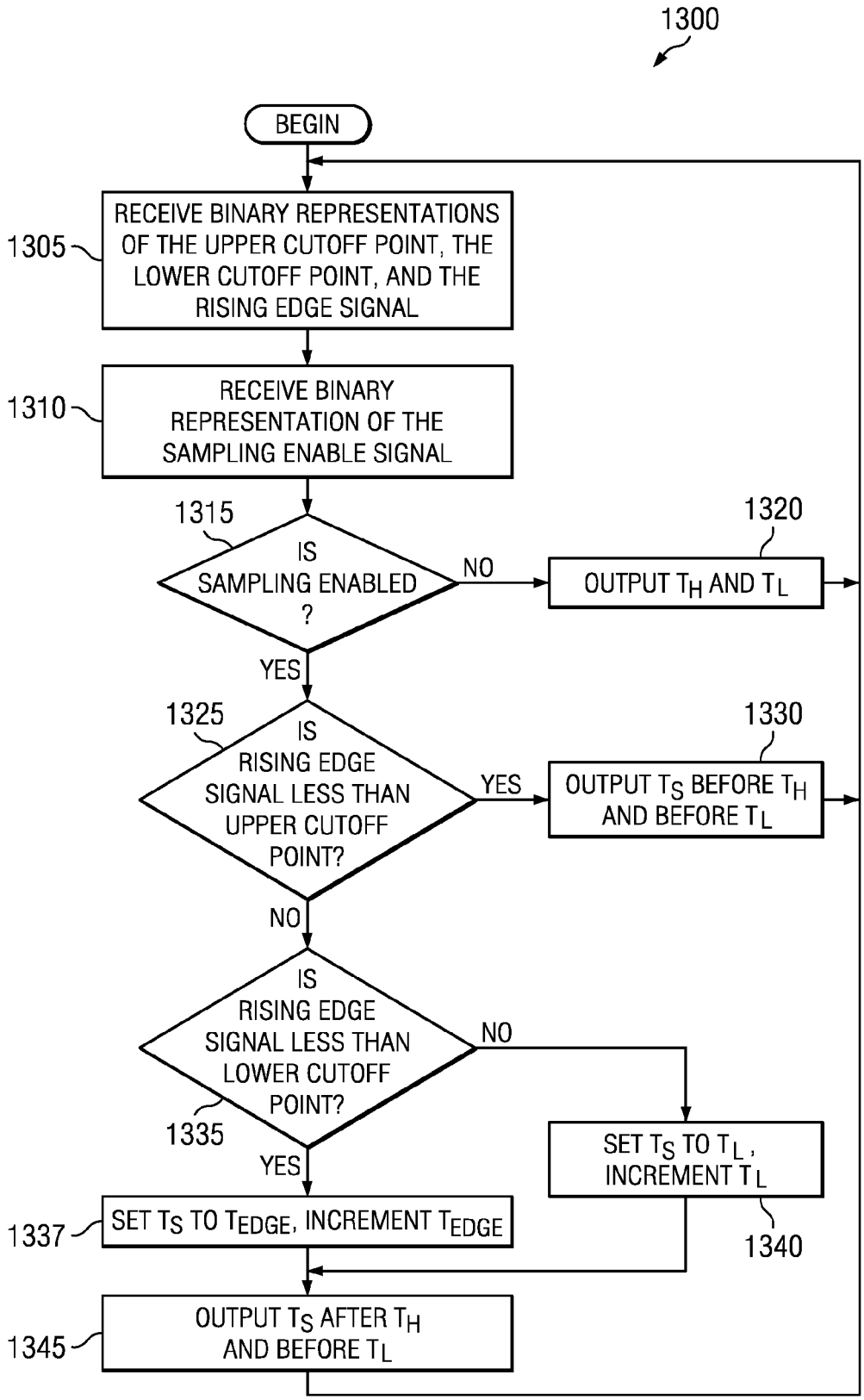
FIG. 13 is a flowchart representative of a process that may be implemented using example machine-readable instructions that may be executed to implement the example impulse timing signal generator of FIG. 7B.

A flowchart representative of an example process that may be implemented using machine-readable instructions for implementing the LED brightness controller 120 of FIG. 3 is shown in FIG. 12. Further, a flowchart representative of an example process that may be implemented using machine-readable instructions for implementing the impulse timing signal generator 775 of FIG. 7B is shown in FIG. 13. In these examples, the machine-readable instructions comprise a program(s) for execution by a processor such as the processor 1412 shown in the example processor system 1400 discussed below in connection with FIG. 14. The program(s) may be embodied in software stored on a computer readable medium such as a CD-ROM, a floppy disk, a hard drive, a digital versatile disk (DVD), or a memory associated with the processor 1412, but the entire program and/or parts thereof could alternatively be executed by a device other than the processor 1412 and/or embodied in firmware or dedicated hardware. Further, although the example program(s) is described with reference to the flowchart illustrated in FIGS. 12 and 13, many other methods of implementing the example LED brightness controller 120 and/or the impulse timing signal generator 775 may additionally or alternatively be used. For example, the order of execution of the blocks may be changed, and/or some of the blocks described may be changed, eliminated, or combined.

FIG. 12 is a flowchart representative of a process that may be implemented using example machine-readable instructions 1200 that may be executed to implement the example LED brightness controller 120 of FIG. 3. The example machine-readable instructions 1200 begin execution upon receiving power via the dimmer control signal 116. First, the period synchronizer 310 receives the dimmer control signal 116 (block 1205). Upon receiving the dimmer control signal 116, the period synchronizer 310 determines the high cutoff point ($T_H$) 520 of the dimmer control signal 116 (block 1210), and then determines the low cutoff point ($T_L$) 525 of the dimmer control signal 116 (block 1215). The period synchronizer 310 of the LED brightness controller 120 then determines the position of the rising edge 205 within the dimmer control signal 116. In the illustrated example the rising edge signal ($T_{Edge}$) 530, the high cutoff point ($T_H$) 520, and the low cutoff point ($T_L$) 525, and sampling signal ($T_S$) 535 (e.g., the timing signals 510) may be implemented as any type of signal. For example, the timing signals may be implemented as impulse signals, or the signals may be implemented as binary counts representing times within the AC period.

The signal positioner 320 of the LED brightness controller 120 determines if the rising edge signal ($T_{Edge}$) 530 occurred before the high cutoff signal ($T_H$) 520 (block 1225). If the rising edge signal ($T_{Edge}$) 530 occurred before the high cutoff signal ($T_H$) 520, the outputter 330 outputs a signal to the LED driver 125 which causes the LED 130 to illuminate at full brightness (block 1230). If the rising edge signal ($T_{Edge}$) 530 occurred after the high cutoff signal ($T_H$) 520, the signal positioner 320 determines if the rising edge signal ($T_{Edge}$) 530 also occurred after the low cutoff signal ($T_L$) 525 (block 1235). If the rising edge signal ($T_{Edge}$) 530 occurred after the low cutoff signal ($T_L$) 525, the outputter 330 outputs a signal to the LED driver 125 that causes the LED 130 to not illuminate (block 1240). If the rising edge signal ($T_{Edge}$) 530 occurred after the high cutoff signal ($T_H$) 520 and before the low cutoff signal ($T_L$) 525, the outputter 330 outputs a signal to the LED driver 125 which causes the LED 130 to illuminate at a scaled brightness (block 1245).

FIG. 13 is a flowchart representative of a process that may be implemented using example machine-readable instructions that may be executed to implement the example impulse timing signal generator 775 of FIG. 7B. The example machine-readable instructions 1300 begin execution upon receiving power via the dimmer control signal 116. First, the impulse timing signal generator 775 receives the 10-bit binary representations of the upper cutoff point 410, the lower cutoff point 415, and the rising edge signal 205 (block 1305). The 10-bit binary representations are received from the 10-bit binary latch 760 and the cutoff generator 720 of the period synchronizer 310 shown in FIG. 7B. Next, the impulse timing signal generator 775 receives the 1-bit binary representation of the sampling enable signal from the positive period detector 770 of FIG. 7B (block 1310). The impulse timing signal generator 775 then determines if sampling is enabled (block 1315). In the illustrated example, sampling is enabled during alternating periods of the dimmer control signal 116, however any other sampling scheme may additionally or alternatively be used. For example, samples may be taken during every period, samples may be taken during every other alternating period, etc.

If sampling is not enabled, the high cutoff signal ($T_H$) 520 and the low cutoff signal ($T_L$) 525 are output from the impulse timing signal generator 775 at the appropriate times (block 1320) and control returns to block 1305 where the impulse timing signal generator 775 receives the binary representations (e.g., the binary representations may have changed from before). The output impulse signals are output by determining if the current count of the 10-bit binary counter 715 match the desired output time of the output impulse timing signals. While in the illustrated example the high cutoff signal ($T_H$) 520 and the low cutoff signal ($T_L$) 525 are output from the impulse timing signal generator 775 when sampling is not enabled, alternative implementations may not output the high cutoff signal ($T_H$) 520 and the low cutoff signal ($T_L$) 525.

If sampling is enabled, the impulse timing signal generator 775 determines if the binary representation of the rising edge signal is less than the binary representation of the upper cutoff point (block 1325). If the binary representation of the rising edge signal is less than the binary representation of the upper cutoff point, the impulse timing signal generator 775 outputs the sampling signal ($T_S$) 535, the high cutoff signal ($T_H$) 520, and the low cutoff signal ($T_L$) 525 at the appropriate times (block 1330). While in the illustrated example the high cutoff signal ($T_H$) 520, the low cutoff signal ($T_L$) 525, and the sampling signal ($T_S$) 535 are output from the impulse timing signal generator 775, alternative implementations may only output the sampling signal ($T_S$) 535 when the binary representation of the rising edge signal is less than the binary representation of the upper cutoff point. Control then returns to block 1305 where the impulse timing signal generator 775 receives the binary representations (e.g., the binary representations may have changed from before).

If the binary representation of the rising edge signal 205 is not less than the binary representation of the upper cutoff point 410, the impulse timing signal generator 775 determines if the binary representation of the rising edge signal 205 is less than the binary representation of the lower cutoff point 415 (block 1335). If the binary representation of the rising edge signal 205 is less than the binary representation of the upper cutoff point 415, then the user has selected that scaled brightness should be output by the LED 130. Thus, the sampling signal ($T_S$) 535 is set to output at the time of the rising edge signal ($T_{Edge}$) 530, and the rising edge signal ($T_{Edge}$) 530 is incremented to prevent incorrect sampling from occurring (block 1337). Alternatively, if the rising edge signal ($T_{Edge}$) 530 is not implemented by the signal positioner 320 (e.g., as shown in the example signal positioner 320 of FIG. 8), the rising edge signal ($T_{Edge}$) 530 may not need to be incremented. If the binary representation of the rising edge signal 205 is not less than the binary representation of the upper cutoff point 415, then the user has selected that no brightness should be output by the LED 130. Thus, the sampling signal ($T_S$) 535 is set to output at the time of the low cutoff signal ($T_L$) 525, and the low cutoff signal ($T_L$) 525 is incremented to prevent incorrect sampling from occurring (block 1340). The low cutoff signal nay be incremented to as late as the end of the AC period or may be omitted all together. For example, alternative implementations may omit the outputs for the low cutoff signal ($T_L$) 525 and the rising edge signal ($T_{Edge}$) 530. Such an implementation may remove the lower boundary placed on sampling the decayed waveform. Instead, a zero crossing signal may be implemented to reset the set-reset latch 820 of FIG. 8. Such a zero crossing signal may be generated by the example zero crossing detector 705 of FIGS. 7A and 7B. In such an example, the sampling signal ($T_S$) 535 may represent the rising edge signal ($T_{Edge}$) 530.

Next, the impulse timing signal generator 775 outputs the sampling signal ($T_S$) 535, the high cutoff signal ($T_H$) 520, and the low cutoff signal ($T_L$) 525 at the appropriate times (block 1345). When the binary representation of the rising edge signal is less than the binary representation of the upper cutoff point, the sampling signal ($T_S$) 535 is indicative of the rising edge signal 205 and causes the LED 130 to output a scaled brightness. Control then returns to block 1305 where the impulse timing signal generator 775 receives the binary representations (e.g., the binary representations may have changed from before).

As mentioned above, the example process(es) of FIGS. 12 and 13 may be implemented using coded instructions (e.g., computer readable instructions) stored on a tangible computer readable medium such as a hard disk drive, a flash memory, a read-only memory (ROM), a compact disk (CD), a digital versatile disk (DVD), a cache, a random-access memory (RAM) and/or any other storage media in which information is stored for any duration (e.g., for extended time periods, permanently, brief instances, for temporarily buffering, and/or for caching of the information). As used herein, the term tangible computer readable medium is expressly defined to include any type of computer readable storage and to exclude propagating signals. Additionally or alternatively, the example process(es) of FIGS. 12 and 13 may be implemented using coded instructions (e.g., computer readable instructions) stored on a non-transitory computer readable medium such as a hard disk drive, a flash memory, a read-only memory, a compact disk, a digital versatile disk, a cache, a random-access memory and/or any other storage media in which information is stored for any duration (e.g., for extended time periods, permanently, brief instances, for temporarily buffering, and/or for caching of the information). As used herein, the term non-transitory computer readable medium is expressly defined to include any type of computer readable medium and to exclude propagating signals.

Figure 14:
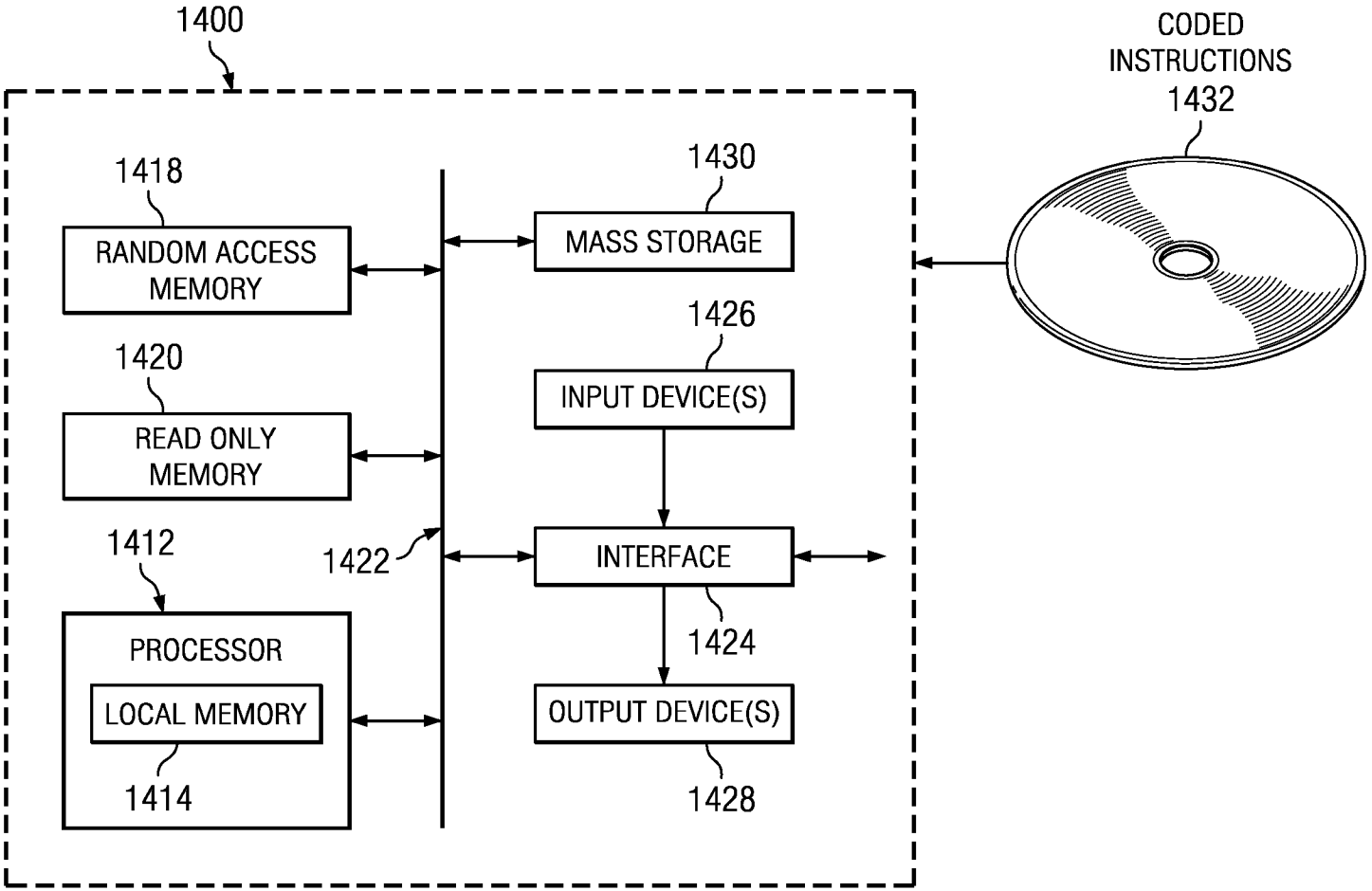
FIG. 14 is a block diagram of an example processor system that may execute, for example, machine-readable instructions implementing the process of FIG. 12.

FIG. 14 is a block diagram of an example processor system 1400 capable of executing the instructions of FIG. 12 to implement the LED brightness controller 120 of FIGS. 1 & 3. The processor system 1400 can be, for example, a computer, an Internet appliance, or any other type of computing device.

The system 1400 of the instant example includes a processor 1412. For example, the processor 1412 can be implemented by one or more TI microprocessors or digital controllers such as MSP430™ or C2000™ families. Of course, other processors from other manufacturers such as Intel® may also be appropriate.

The processor 1412 is in communication with a main memory including a volatile memory 1414 and a non-volatile memory 1416 via a bus 1418. The volatile memory 1414 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 1416 may be implemented by flash memory and/or any other desired type of memory device. Access to the main memory 1414, 1416 is typically controlled by a memory controller (not shown).

The example processor system 1400 also includes an interface circuit 1420. The interface circuit 1420 may be implemented by any type of interface standard, such as an Ethernet interface, a universal serial bus (USB), and/or a PCI express interface.

One or more input devices 1422 are connected to the interface circuit 1420. The input device(s) 1422 permit a user to enter data and commands into the processor 1412. The input device(s) can be implemented by, for example, a dial, a slider, a mouse, a touchscreen, a track-pad, a trackball, isopoint and/or a voice recognition system.

One or more output devices 1424 are also connected to the interface circuit 1420. The output devices 1424 can be implemented, for example, by display devices (e.g., a liquid crystal display, a cathode ray tube display (CRT), and/or lights).

The interface circuit 1420 also includes a communication device such as a modem or network interface card to facilitate exchange of data with external computers via a network 1426 (e.g., an Ethernet connection, a digital subscriber line (DSL), a telephone line, coaxial cable, a cellular telephone system, etc.).

The processor system 1400 also includes one or more mass storage devices 1428 for storing software and data. Examples of such mass storage devices 1428 include floppy disk drives, hard drive disks, compact disk drives and digital versatile disk (DVD) drives. The mass storage device 1428 may implement the memory 1010.

The coded instructions of FIG. 12 may be stored in the mass storage device 1428, in the volatile memory 1414, in the non-volatile memory 1416, and/or on a removable storage medium such as a CD or DVD.

From the foregoing, it will be appreciated that the above disclosed methods, apparatus and articles of manufacture allows the brightness of LED lights to be accurately and controllably be dimmed between full brightness and no brightness. Further, lower pin count and therefore lower cost can be achieved as the LED brightness controller 120 can be implemented via a minimal amount of components. The led brightness level can be quickly determined as computational quickness is determined by the frequency of the AC source signal. The LED brightness controller 120 also provides filtering to the dimmer control signal, which removes inherent asymmetry present in the TRIAC circuitry of the dimmer 113.

Although certain example methods, apparatus, and articles of manufacture have been described herein, the scope of coverage of this patent is not limited thereto. On the contrary, this patent covers all methods, apparatus, and articles of manufacture fairly falling within the scope of the claims of this patent.

What is claimed is:

1. A method to control LED brightness comprising:

receiving a dimmer control signal;

determining a cutoff point of the dimmer control signal;

determining the position of a rising edge signal within the dimmer control signal;

determining if the rising edge signal occurred before the cutoff point; and outputting an LED brightness signal indicating full brightness when the rising edge signal occurred before the cutoff point, and indicating a scaled brightness when the rising edge signal did not occur before the cutoff point.

2. The method as described in claim 1, wherein the dimmer control signal is a periodic signal.

3. The method as described in claim 1, wherein the dimmer control signal is an alternating current signal chopped by a triode for alternating current.

4. The method as described in claim 1, further comprising:

determining a second cutoff point of the dimmer control signal, wherein the first cutoff point represents a high cutoff point and the second cutoff point represents a low cutoff point;

determining if the rising edge signal occurred before the second cutoff point; and outputting an LED brightness signal indicating a scaled brightness when the rising edge signal did not occur before the first cutoff point and occurred before the second cutoff point, and indicating no brightness when the rising edge signal did not occur before the second cutoff point.

5. The method as described in claim 4, further comprising:

synchronizing a counter to the dimmer control signal, wherein the counter is reset at the beginning of each cycle of the received dimmer control signal;

storing in a memory a value representative of the first cutoff point;

storing in the memory a value representative of the second cutoff point; and storing in the memory a value of the counter representative of the time when the rising edge signal was received.

6. The method as described in claim 4, wherein the first and second cutoff points indicate one fourth and three fourths, respectively, of the period the dimmer control signal.

7. The method as described in claim 1, further comprising:

determining whether the output LED brightness signal should be changed to reflect a second rising edge signal, the second rising edge signal being received after the first rising edge signal;

outputting the same LED brightness signal until it is determined that the output LED brightness signal should be changed to reflect the second rising edge signal.

8. The method as described in claim 7, wherein determining whether the output LED brightness signal should be changed to reflect the second rising edge signal comprises receiving a sampling enable signal and determining that the output LED brightness signal should be changed when the sampling enable signal is received at substantially the same time as the rising edge signal.

9. The method as described in claim 7, wherein determining whether the output LED brightness signal should be changed to reflect the second rising edge signal comprises monitoring the received dimmer control signal and determining that the output LED brightness signal should be changed when the received dimmer control signal is in an alternating period.

10. The method as described in claim 1, wherein the scaled brightness is exponentially scaled.

11. The method as described in claim 10, wherein the exponential scaling is implemented by an analog circuit having an exponential decay.

12. The method as described in claim 10, wherein the exponential scaling is implemented using an exponential digital to analog converter.

13. An apparatus to control LED brightness comprising:

a period synchronizer to synchronize an accumulator to the period of an input AC signal and to generate a cutoff signal;

a signal positioner to determine the position of a rising edge signal relative to the cutoff signal; and an outputter to output an LED brightness control signal based on the position of the rising edge signal relative to the cutoff signal.

14. The apparatus as described in claim 13, wherein the AC signal is a dimmer control signal output by a dimmer.

15. The apparatus as described in claim 13, wherein:

the period synchronizer additionally generates a second cutoff signal;

the signal positioner determines the position of the rising edge signal relative to the first and second cutoff signals;

and the outputter outputs the LED brightness control signal based on the position of the rising edge signal relative to the first and second cutoff signals.

16. The apparatus as described in claim 15, wherein the signal positioner comprises:

the accumulator synchronized to the input AC signal, wherein the accumulator is implemented by a counter incremented by an oscillator and is reset at the beginning of each period of the input AC signal;

a memory to store values representing the first cutoff signal, the second cutoff signal, and the position of the rising edge signal;

a differencer to determine a difference between the values representing the first cutoff point, the second low cutoff point, and the position of the rising edge signal, and create a linear output signal;

and an exponential digital to analog converter to convert the linear output signal to an exponential output signal.

17. The apparatus as described in claim 15, wherein the signal positioner comprises:

the accumulator synchronized to the input AC signal, wherein the accumulator is implemented by a resistor, a capacitor, and a set-reset latch;

the set-reset latch to become set upon receiving a signal representative of the first cutoff point, and to be reset upon receiving either the rising edge signal or a signal representative of the second cutoff point; and a sampler and holder to sample and hold the value stored in the accumulator.

18. The apparatus as described in claim 17, wherein the sampler and holder samples and holds the value stored in the accumulator when receiving a sampling signal.

19. The apparatus as described in claim 17, wherein the resistor and the capacitor are discharged when the set-reset latch is set.

20. The apparatus as described in claim 19, wherein when discharged, the resistor and capacitor exhibit an exponentially decayed response.

* * * * *